US011103800B1

(12) United States Patent
Roberts et al.

(10) Patent No.: US 11,103,800 B1
(45) Date of Patent: Aug. 31, 2021

(54) TOY ROBOT WITH PROGRAMMABLE AND MOVABLE APPENDAGES

(71) Applicant: Hasbro, Inc., Pawtucket, RI (US)

(72) Inventors: Spencer A Roberts, North Providence, RI (US); Don Cameron, Riverside, RI (US); Bradley Caldwell, Wesport, NY (US); Daniel Judkins, Providence, RI (US)

(73) Assignee: Hasbro, Inc., Pawtucket, RI (US)

( * ) Notice: Subject to any disclaimer, the term of this patent is extended or adjusted under 35 U.S.C. 154(b) by 641 days.

(21) Appl. No.: 15/605,021

(22) Filed: May 25, 2017

Related U.S. Application Data

(60) Provisional application No. 62/460,262, filed on Feb. 17, 2017.

(51) Int. Cl.

| | |
|---|---|
| ***A63H 3/36*** | (2006.01) |
| ***A63H 30/04*** | (2006.01) |
| ***A63H 29/22*** | (2006.01) |
| ***A63H 3/46*** | (2006.01) |
| ***A63H 3/48*** | (2006.01) |

(52) U.S. Cl.
CPC ..... *A63H 3/36* (2013.01); *A63H 3/46* (2013.01); *A63H 3/48* (2013.01); *A63H 29/22* (2013.01); *A63H 30/04* (2013.01); *A63H 2200/00* (2013.01)

(58) Field of Classification Search
CPC ... A63H 3/20; A63H 3/36; A63H 3/46; A63H 3/48; A63H 3/50; A63H 29/22; A63H 30/04; A63H 2200/00; A63H 13/00; A63H 13/04; A63H 13/12
USPC ..... 446/320, 331, 330, 352, 353, 354, 358
See application file for complete search history.

(56) References Cited

U.S. PATENT DOCUMENTS

| | | | | | |
|---|---|---|---|---|---|
| 1,585,887 | A * | 5/1926 | Beach | A63H 13/16 | 446/310 |
| 2,243,043 | A * | 5/1941 | Walter | A63H 11/10 | 446/355 |
| 2,496,725 | A * | 2/1950 | Hotcaveg | A63H 13/06 | 446/335 |
| 2,637,936 | A * | 5/1953 | Dale | A63H 13/00 | 40/411 |
| 2,695,472 | A * | 11/1954 | Ardolino | A63H 3/28 | 369/63 |
| 2,716,838 | A * | 9/1955 | Quercetti | A63H 11/00 | 280/1.181 |
| 3,199,249 | A * | 8/1965 | Carver | A63H 11/10 | 294/106 |

(Continued)

FOREIGN PATENT DOCUMENTS

EP 1071498 B1 11/2005

*Primary Examiner* — Joseph B Baldori
(74) *Attorney, Agent, or Firm* — Perry Hoffman

(57) ABSTRACT

A toy robot doll having upper and lower body portions and wheels that may be controlled by an operator with a remote smart device. A lower platform is connected to the lower body portion and an upper platform is connected to the upper body portion. A set of springs is mounted between the upper and lower platforms for biasing the platforms apart, and three cams and six cam followers move the platforms toward one another, move the doll's arms forward and outward, and move a head right and left. Another two cams pivot the head up, where all of the movements simulate dance steps and body movements that an operator may program using the smart device.

5 Claims, 22 Drawing Sheets

(56) References Cited

U.S. PATENT DOCUMENTS 3,641,702 A * 2/1972 Gardel ..... A63H 13/00 446/333
3,712,629 A * 1/1973 Watanabe ..... A63H 33/30 369/277
3,797,166 A * 3/1974 Murray ..... A63H 3/48 446/320
3,888,023 A * 6/1975 Genin ..... A63B 69/00 40/411
4,095,367 A * 6/1978 Ogawa ..... A63H 11/00 446/288
4,305,222 A * 12/1981 Terzian ..... A63H 11/18 446/288
4,312,150 A * 1/1982 Terzian ..... A63H 11/18 446/354
4,355,482 A * 10/1982 Sapkus ..... A63H 11/10 446/279
4,507,098 A * 3/1985 Terzian ..... A63H 13/12 446/288
4,526,552 A * 7/1985 Rhodes ..... A63H 3/48 446/320
4,527,446 A * 7/1985 Borodin ..... B25J 9/046 414/732
4,545,775 A * 10/1985 Kim ..... A63H 3/28 446/299
4,599,909 A * 7/1986 Koller ..... B23Q 1/621 74/27
4,636,177 A * 1/1987 Koguchi ..... A63H 1/28 446/236
4,662,856 A * 5/1987 Getgey ..... A63H 17/25 446/280
4,752,272 A * 6/1988 Karasawa ..... A63H 31/08 446/289
4,802,879 A 2/1989 Rissman et al.
4,824,416 A 4/1989 Chun-Hoi et al.
4,828,530 A * 5/1989 Lee ..... A63H 13/00 40/419
4,875,886 A * 10/1989 Sung ..... A63H 13/04 446/298
4,901,459 A * 2/1990 Lee ..... G09F 19/08 40/414
4,939,944 A * 7/1990 Hou ..... F16H 21/36 428/16
4,944,708 A * 7/1990 Kawabe ..... A63H 11/18 446/175
5,003,714 A * 4/1991 Satoh ..... G09F 19/08 40/411
5,011,448 A * 4/1991 Asano ..... A63H 11/10 446/293
5,088,954 A 2/1992 Terzian et al.
5,134,796 A * 8/1992 Satoh ..... A63H 13/00 40/414
5,158,492 A * 10/1992 Rudell ..... A63H 3/48 446/175
5,176,560 A * 1/1993 Wetherell ..... A63H 3/46 446/175
5,186,436 A * 2/1993 Cummings, Jr. ..... A01K 3/005 254/29 R
5,259,806 A * 11/1993 Chang ..... A63H 5/00 446/270
5,273,479 A * 12/1993 Chang ..... A63H 13/12 446/272
5,277,646 A * 1/1994 Fekete ..... A63H 33/00 446/278
5,308,276 A * 5/1994 Fogarty ..... A63H 13/04 446/268
5,584,741 A * 12/1996 Cheung ..... A63H 3/28 40/414
5,602,622 A * 2/1997 Ziegler ..... G03B 27/6271 355/75
5,651,717 A * 7/1997 Hamilton ..... A63H 3/20 446/330
5,679,050 A * 10/1997 LLorens ..... A63H 3/38 446/341
5,888,138 A * 3/1999 Suganuma ..... A63F 9/143 446/277
5,893,791 A 4/1999 Wilkinson
6,135,848 A * 10/2000 Hou ..... A63H 3/48 446/268
6,149,490 A * 11/2000 Hampton ..... A63H 3/28 446/298
6,175,772 B1 1/2001 Kamiya et al.
6,200,192 B1 * 3/2001 Hou ..... A63H 3/20 446/352
6,210,249 B1 * 4/2001 Stadlbauer ..... A63H 3/24 446/330
6,244,925 B1 * 6/2001 Chou ..... A63H 13/00 40/418
6,267,639 B1 * 7/2001 Menow ..... A63H 5/00 221/152
6,315,630 B1 * 11/2001 Yamasaki ..... A63H 11/10 446/275
6,356,867 B1 3/2002 Gabai
6,371,827 B1 * 4/2002 Chou ..... A63H 3/006 446/219
6,375,536 B1 * 4/2002 Yang ..... A63H 3/48 40/411
6,431,940 B1 * 8/2002 Buford ..... A63H 11/10 446/277
6,497,607 B1 12/2002 Hampton et al.
6,500,043 B1 * 12/2002 Fong ..... A63H 3/20 40/414
6,514,117 B1 2/2003 Hampton et al.
6,524,158 B1 * 2/2003 Fong ..... A63H 3/20 40/414
6,537,128 B1 3/2003 Hampton et al.
6,544,098 B1 4/2003 Hampton et al.
6,572,432 B1 * 6/2003 Tsai ..... A63H 3/36 446/314
6,579,143 B1 * 6/2003 Rehkemper ..... A63H 3/48 446/175
6,616,503 B1 * 9/2003 Fong ..... A63H 3/20 446/330
6,645,035 B1 * 11/2003 Tsai ..... A63H 3/48 446/300
6,652,351 B1 * 11/2003 Rehkemper ..... A63H 13/02 446/312
6,663,393 B1 * 12/2003 Ghaly ..... A63H 3/28 434/262
6,761,612 B1 * 7/2004 Pencil ..... A63H 13/16 40/411
6,773,327 B1 8/2004 Felice et al.
6,939,192 B1 9/2005 Munch et al.
6,953,379 B1 * 10/2005 Wang ..... A63H 3/20 446/300
7,066,782 B1 6/2006 Maddocks et al.
7,131,887 B2 * 11/2006 Hornsby ..... A63H 3/48 446/484
7,217,171 B2 * 5/2007 Hsu ..... A63H 3/28 40/414
7,356,951 B2 * 4/2008 Spielberger ..... G09F 15/0025 40/412
7,416,468 B1 8/2008 Felice et al.
7,431,629 B1 10/2008 Maddocks et al.
7,507,139 B1 3/2009 Maddocks et al.
7,938,708 B2 * 5/2011 Willet ..... A63H 11/205 446/330
7,946,902 B2 * 5/2011 Willett ..... A63H 17/006 446/353
8,157,612 B2 * 4/2012 Rehkemper ..... A63H 13/04 446/331
8,851,955 B2 * 10/2014 Zhang ..... A63H 13/18 446/176
8,920,207 B2 * 12/2014 Hageman ..... A63H 33/086 446/124
9,233,312 B1 1/2016 Dressendofer et al.
9,248,380 B1 * 2/2016 Long ..... A63H 13/02
9,364,950 B2 * 6/2016 Izhikevich ..... B25J 9/0081

(56) References Cited

U.S. PATENT DOCUMENTS 9,533,413 B2 * 1/2017 Izhikevich ..... B25J 9/163
9,862,092 B2 * 1/2018 Izhikevich ..... B25J 9/163
10,105,613 B1 * 10/2018 Patterson ..... A63H 15/06
2002/0081937 A1 * 6/2002 Yamada ..... A63H 3/48 446/175
2002/0098770 A1 * 7/2002 Mesch ..... A63H 13/16 446/310
2002/0108796 A1 * 8/2002 Baker ..... A63H 11/10 180/181
2002/0193045 A1 * 12/2002 Lee ..... A63H 11/10 446/330
2003/0032363 A1 * 2/2003 Kawashiro ..... A63H 11/10 446/226
2003/0070352 A1 * 4/2003 Ellis ..... A01C 11/00 47/1.01 P
2003/0092353 A1 * 5/2003 Liu ..... A63H 3/20 446/330
2003/0232569 A1 * 12/2003 Yu ..... A63H 3/20 446/330
2004/0198160 A1 * 10/2004 Fong ..... A63H 3/20 446/330
2006/0270312 A1 11/2006 Maddocks et al.
2008/0020670 A1 * 1/2008 Kratz ..... A63H 11/10 446/175
2008/0026669 A1 1/2008 Rehkemper et al.
2009/0104841 A1 * 4/2009 Yen ..... A63H 11/00 446/298
2009/0253350 A1 * 10/2009 Kobayashi ..... A63H 11/00 446/490
2010/0151767 A1 * 6/2010 Rehkemper ..... A63H 11/20 446/330
2012/0088434 A1 4/2012 Teel et al.
2012/0142247 A1 * 6/2012 Hara ..... A63H 33/003 446/72
2012/0282843 A1 * 11/2012 Tobias ..... A63H 3/20 446/376
2013/0045659 A1 * 2/2013 Tobias ..... A63H 3/48 446/376
2013/0065482 A1 3/2013 Trickett
2014/0060224 A1 * 3/2014 Amino ..... B25J 17/00 74/89
2014/0248820 A1 * 9/2014 Mantzel ..... A63H 11/20 446/429
2015/0017876 A1 * 1/2015 Russo ..... A63H 31/00 446/484
2015/0258683 A1 * 9/2015 Izhikevich ..... B25J 9/163 700/250
2015/0265940 A1 * 9/2015 Chan ..... A63H 33/28 446/16
2016/0016088 A1 * 1/2016 White ..... A63H 11/18 446/330
2016/0059308 A1 * 3/2016 Volk ..... B33Y 30/00 428/615
2017/0028458 A1 * 2/2017 Wilkosz ..... B21D 31/005

* cited by examiner

TOY ROBOT WITH PROGRAMMABLE AND MOVABLE APPENDAGES

PRIORITY CROSS-REFERENCE TO RELATED APPLICATION

This application claims priority pursuant to 35 U.S.C. 119(e) from U.S. Provisional Patent Application No. 62/460,262 filed on Feb. 17, 2017.

FIELD OF THE INVENTION

The present invention relates to toy robots, and more particularly, to one such robot in the form of a dancing, entertaining toy doll with movable and programmable appendages, such as the doll's arms, head and body.

BACKGROUND OF THE INVENTION

Movable toy dolls are known including dolls having moveable facial features operated by a processor. For example, U.S. Patent Application Publication number 2006/0270312, entitled Interactive Animated Characters and listing Maddocks, Rodriquez, Ford and Hall as inventors, purports to disclose an interactive animated toy character that uses a processor, a motor, a control shaft, and multiple cams and cam followers to move eyes, eye lids, mouth, brow, ears, plume, chest and feet of the character, which is illustrated as a furry doll marketed under the brand FURBY®. The cams are provided with precise predetermined shapes, which are coordinated by the processor's programming. In this manner the character may be provided with multiple different predetermined physical and emotional expressions, including those responsive to input from a child. The input may be in the form of holding the toy, and/or petting and tickling the toy. For example, the child is able to pet the toy's tummy, rub its back or rock it and embedded sensors communicate these motions to the processor.

In addition to the Application Publication of the previous paragraph, relevant disclosures may exist in earlier patents identified in the Application Publication, including U.S. Pat. Nos. 6,149,490; 6,497,607; 6,514,117; 6,537,128; and 6,544,098 all of which concern the FURBY® toy identified above.

Another patent, EP 1,071,498 issued in 2005 to an assignee of McDonald and Ewing, and entitled Touch-Responsive Doll Having Arm Motion, purports to disclose a doll exhibiting arm motion upon impact or touch. A switch is activated when the doll is touched and generates a signal to a control circuit. The control circuit initiates operation of a motor that rotates a cam, which in turn motivates a cam follower to move a doll's arm. A biasing spring causes the arm to return to its start position.

Also in 2005, a U.S. Patent issued to Munch and Rasmussen, U.S. Pat. No. 6,939,192 for a Programmable Toy With Communication Means that purports to disclose a toy with a receiver for handling instructions for programming of a toy, and elements for executing the received instructions. The toy, such as a LEGO® EV3 robot, includes a microprocessor that may be programmed by a smart device and may receive signals from sensors that may detect images, sound, light and touch.

U.S. Pat. No. 6,773,327, issued to an assignee of Felice and Maddocks in 2004 for an Apparatus For Actuating A Toy, purports to describe a toy with movable limbs structured with a flexible strip and two elongated cords, one to each side of the strip, where both cords are connected to two arms of a motor. When the motor rotates in one direction and then the other direction compound movements of the limbs are achieved. A more recent patent, U.S. Pat. No. 9,233,312, issued to Dressendofer and Vigliotti in 2016 for an Animated Dancing Doll And Instructional Method Therewith, purports to disclose a doll with legs that pivot at the hip, the knees and the ankles allowing the doll to move in the vertical direction.

SUMMARY OF THE INVENTION

The following disclosure describes in detail compact, efficient and robust mechanisms and a toy robot for using the mechanisms, where the mechanisms enable the toy to move in a vertical direction, appendages on the toy to move forward and outward, a head to pitch, and a body to simulate dance steps. Not only are the mechanisms compact, efficient and robust, but also the mechanisms are simply constructed, easy to use and provide the toy with great play value. The toy may be controlled with a smart device, but the toy may also be responsive to manual movements of the appendages.

Briefly summarized, the invention relates to a toy robot apparatus including an upper portion of the apparatus for supporting appendages, a lower portion of the apparatus for supporting the upper portion and the appendages, a first platform mounted to the lower portion of the apparatus, a second platform mounted to the upper portion of the apparatus and spaced from the first platform, the second platform being movable relative to the first platform, and structure mounted in the apparatus to enable movement of the second platform relative to the first platform.

The invention also relates to a method for assembling a toy robot apparatus including the steps of providing an upper portion of the apparatus, providing a lower portion of the apparatus connected to the upper portion, connecting a first platform to the lower portion, connecting a second platform to the upper portion, the second platform being movable relative to the first platform, connecting a cam and a cam follower to the upper portion, the cam and cam follower enabling movement of the second platform toward the first platform, and mounting a spring between the first and second platforms to enable, with the cam and cam follower, the second platform to move away from the first platform.

BRIEF DESCRIPTION OF THE DRAWINGS

For the purpose of facilitating an understanding of the invention, the accompanying drawings and detailed description illustrate preferred embodiments thereof, from which the invention, its structures, its constructions and operations, its processes, and many related advantages may be readily understood and appreciated.

DESCRIPTION OF THE PREFERRED EMBODIMENTS

The following description is provided to enable those skilled in the art to make and use the described embodiments set forth in the best mode contemplated for carrying out the invention. Various modifications, equivalents, variations, and alternatives, however, will remain readily apparent to those skilled in the art. Any and all such modifications, variations, equivalents, and alternatives are intended to fall within the spirit and scope of the present invention.

Figure 1:
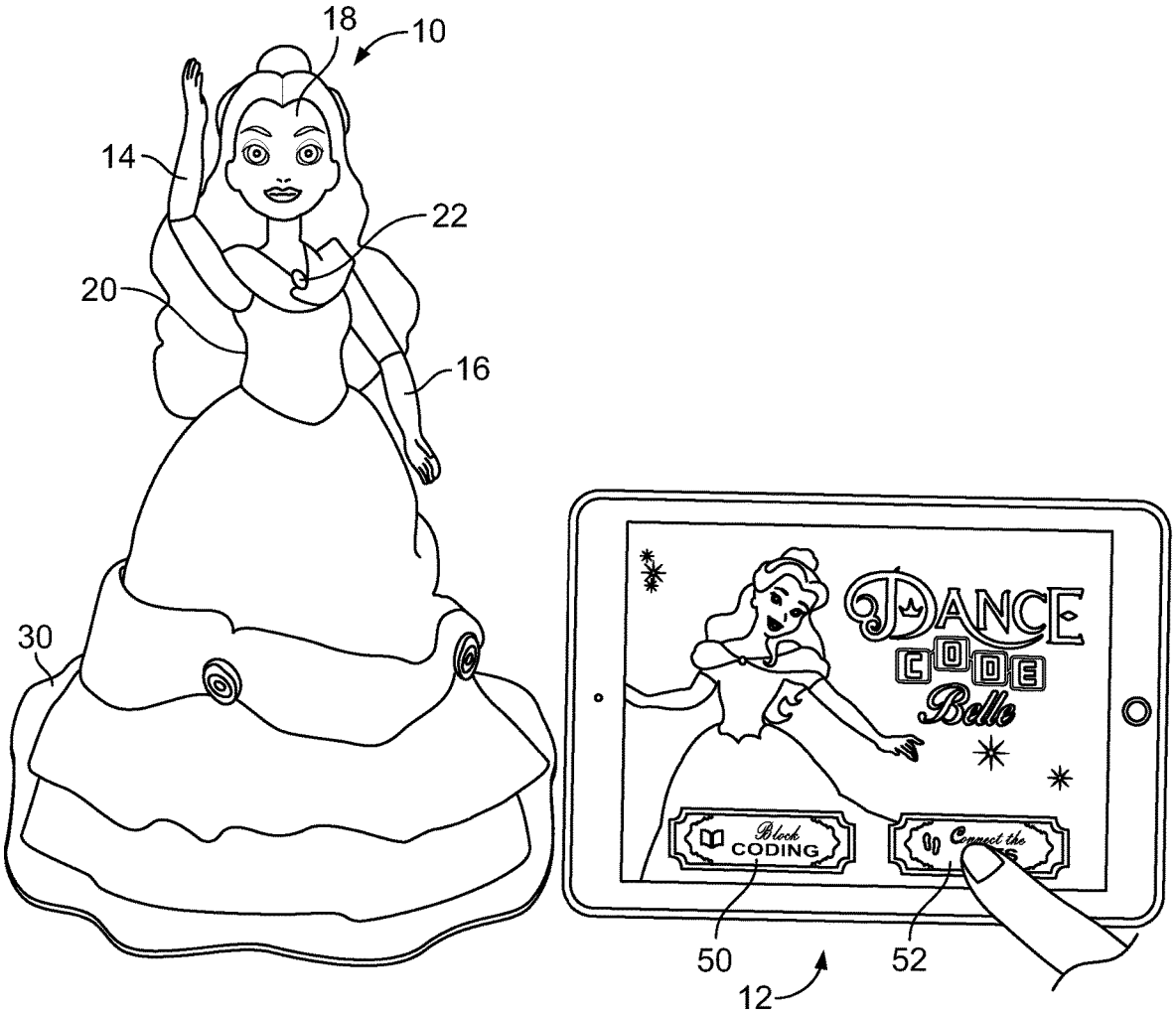
FIG. 1 is a front elevation view of a toy robot apparatus and a plan view of a smart device, the toy robot being in the form of a doll exhibiting the likeness of the main character Belle from the movie, Disney's Beauty and the Beast®, the doll having movable arms, head and body.

Referring first to FIG. 1, there is illustrated an embodiment of the present toy robot apparatus invention in the form of an elegantly dressed doll 10 and a smart device 12, such as an iPad® tablet or an iPhone® smart phone. The doll 10 bears the likeness of Belle, the main character from the movie, Disney's Beauty and the Beast®. The doll may be constructed, preprogrammed, programmed or coded to simulate dance routines including body, arm and head movements. Use of the smart device 12 is one alternative where an operator or player may program a dance routine. Another alternative is for the player to manually move the doll's arms and activate switches. The player of the smart device may operate the device in one of two modes. In one mode the player may cause the graphical user interface to invite the player to program in 'Block Coding.' In a second mode the player may code in 'Connect the Dots.' If the robot is formed as a warrior, a vehicle or as a building structure, the various inputs may launch projectiles, raise protective shields and/or have other features.

In the alternative, other inputs may be used to motivate the doll, such as audio instructions, player directed light beams, and/or player touch commands.

Figure 19:
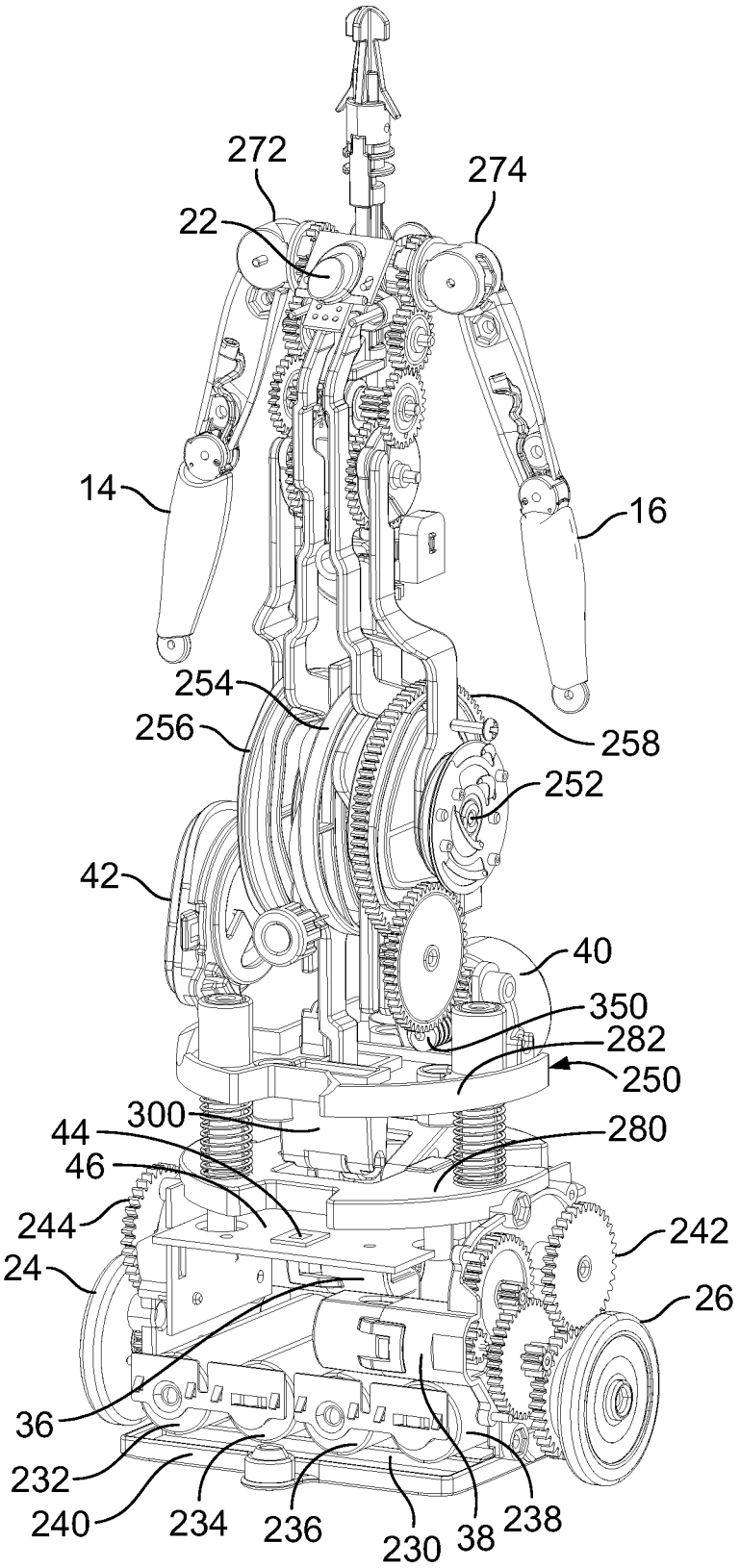
FIG. 19 is an enlarged front isometric view of the doll shown in FIGS. 1 and 13-18, absent the head and illustrating the doll's internal mechanisms.

In more detail regarding the doll robot 10, FIG. 1 the player may selectively move the doll's arms 14, 16 and programs may selectively move the arms, a head 18 and/or a body 20 in simulated dance routines. Inputs from the player may also come by way of a button switch 22 disguised as a necklace or brooch, which may, when pressed once, result in the doll performing a preprogrammed dance routine and when pressed twice, the doll may offer dance lessons to the player. Other inputs may be created to result in additional or alternative dance routines. The doll includes right and left wheels 24, 26, FIG. 19, to move the doll along a flat support surface, such as a table 30, FIG. 1, the wheels being monitored to determine wheel positions and movements. The arms 14, 16 may also be monitored to signal arm positions, and BLE may be provided for short-range communication. There may also be a lift switch 32, FIG. 17, to stop various motors 36, 38, 40, FIGS. 19-21, within the doll when the doll is raised off the support surface 30. The doll may also include a speaker assembly 42, FIG. 19, and an on/off switch (not shown). For outputs, the doll may include an RGB LED in the button switch 22, the speaker assembly 42, the right wheel motor 36, the left wheel motor 38 and the cam drive motor 40, all of which are in communication with a microprocessor 44, FIG. 19, shown diagrammatically, on a circuit board 46.

In the alternative, the arms and head may have greater movement ranges and more functions then those illustrated, other elements may be added to the doll to provide additional play value, the microprocessor may be more powerful, and additional preprogramming apps may be included. For example, a microphone may be placed in the body to allow an audible exchange between the doll and a player. As additional examples, more mechanisms may be added to animate other features of the doll, such as a face on the head 18 that simulates emotions, or weapon appendages attached to a movable soldier body. Yet more examples include the use of more appendages should the toy robot simulate an alien, or the robot may operate with different functions should the toy apparatus be a vehicle or a building structure.

Figure 2:
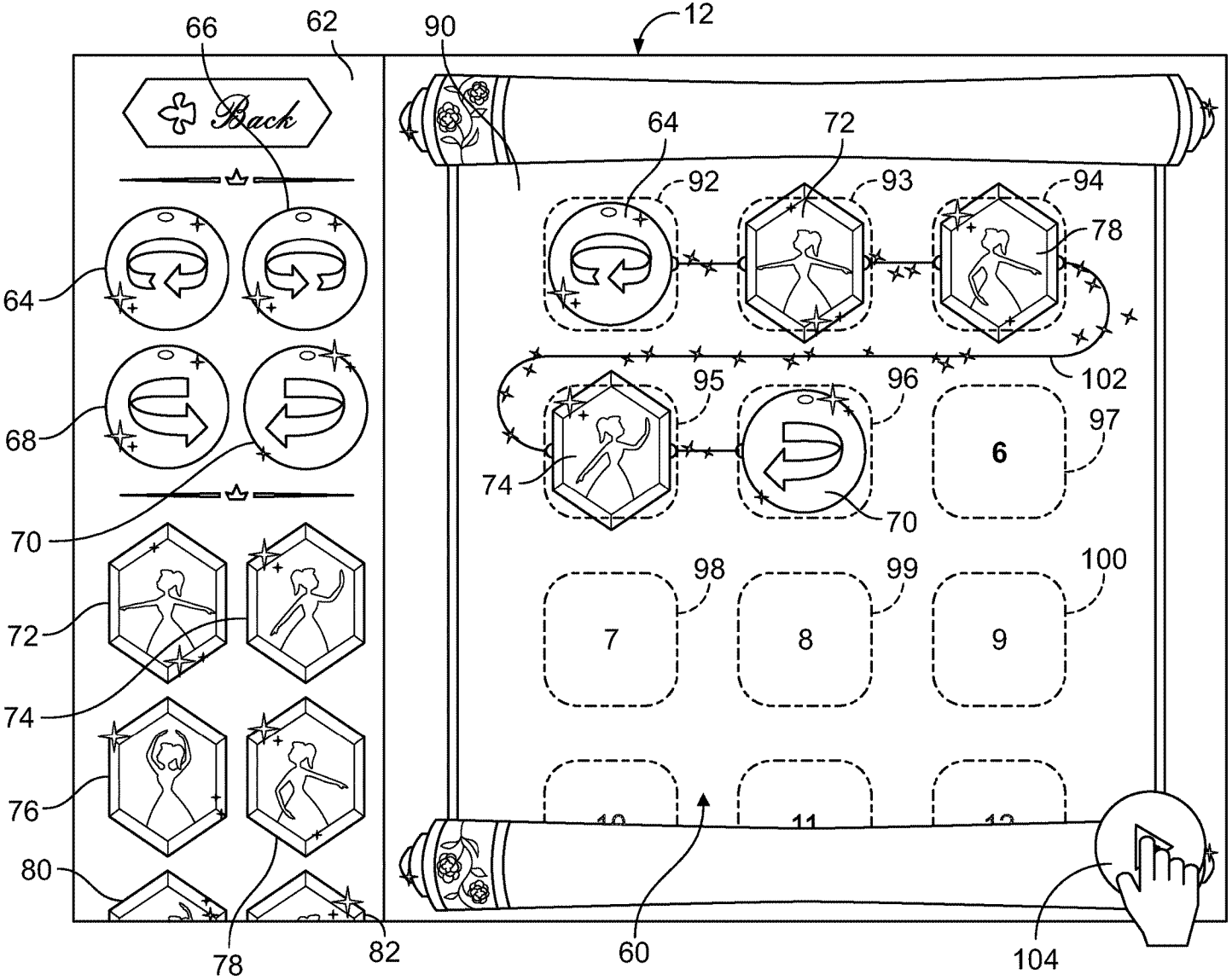
FIG. 2 is a plan view of the smart device in the form of a smart tablet computer that displays dance step and arm movement input icons in a first region of the tablet and a sequence of icon receiving blocks in a second region of the tablet.

The graphical user interface on the smart device 12, FIG. 1, illustrates a dancing Belle figure, a title and two selection icons, a 'Block Coding' button or icon 50, FIG. 1, and a 'Connect the Dots' button or icon 52. Referring now to FIG. 2, operation of the doll by a player using the smart pad 12 is illustrated after the player has pressed the Block Coding button 50. A display or screen 60 may have a first region 62 on the left featuring circular and hexagon shaped input icons 64, 66, 68, 70, 72, 74, 76, 78, 80, 82 that illustrate movements of the wheels 24, 26, referred to here as 'dance step icons' (icons 64, 66, 68, 70) and arms 14, 16 and head 18 movements of the Belle doll, referred to here as 'Belle icons' (icons 72, 74, 76, 78, 80, 82). Dance step icons may feature wheel movements, such as a twirl or rotation to the right (clockwise), and a twirl or rotation to the left (counterclockwise), where one wheel moves and the other wheel is stationary, and a curve right and a curve left movements, where one wheel may move at about 100% velocity and the other wheel may move at about 50%. Other wheel movements may include both wheels going forward and rearward. The Belle icons may illustrate a silhouetted Belle with her arms and head in different positions. Of course, it should be understood that more, fewer or different icons may be used, and for a twirl movement one wheel may move forward and other wheel may move rearward at the same or different velocities.

A second region 90 of the display 60 on the right may include rows and columns of blocks 92, 93, 94, 95, 96, 97, 98, 99, 100 that are each available for receipt of a dance step icon or a Belle icon selected by the player. Selection occurs when the player touches the desired dance step or Belle icon in the first region 62 of the display and then drags or moves that selected icon from the first region 62 unto a block in the second region 90 of the display. The player also decides the order or sequence 102 of the dance step and Belle icons. This allows a child to learn a valuable lesson of basic programming. Once the sequence 102 is decided, the child pushes a button 104 at the bottom-right side of the display 60 to execute the player-created dance routine.

Figure 3:
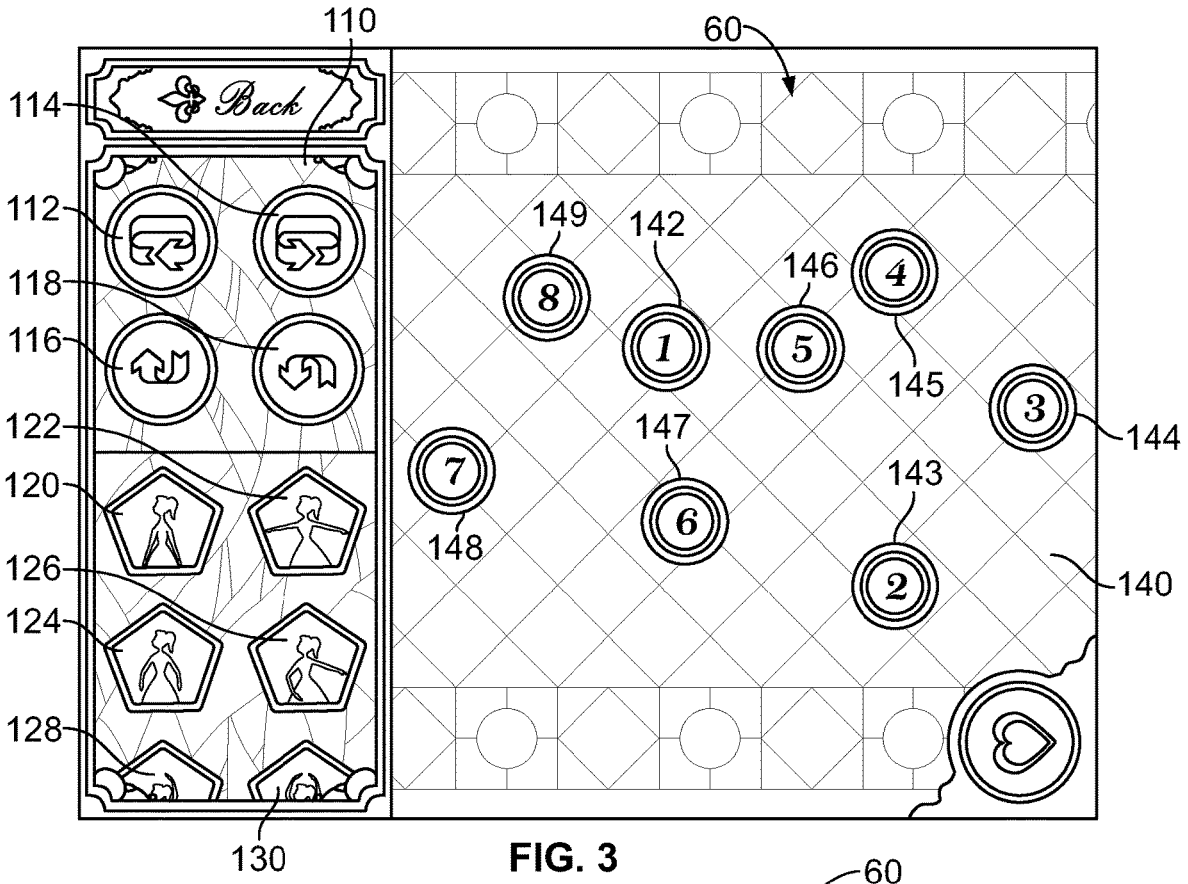
FIG. 3 is a plan view of the smart tablet computer that displays the dance step and arm movement input icons in the first region of the tablet and a series of numbered dots for receiving the icons in the second region of the tablet.

Another interaction between the player and the doll occurs when the player presses the Connect the Dots button 52, FIG. 1. The display 60, FIG. 3, of the smart device may again be divided into two regions, a first region 110 on the left having circular dance step icons 112, 114, 116, 118 and Belle icons 120, 122, 124, 126, 128, 130, each in the shape of a pentagon. The second region 140, of the display may illustrate an automatic distribution of circular dots 142, 143, 144, 145, 146, 147, 148, 149 numbered in sequence from one to eight. The Connect the Dots game is different from the Block Coding game because the dots may be distributed randomly. For example, if there are only two dots, one centered at the top of the display and one centered at the bottom, the player is able to draw a line with her finger from the first dot to the second dot. The dots may then change shape and/or color to show that they are ready to receive icons. The player may place a dance step icon, such as the rotate counterclockwise icon, on the first dot and a Belle arms up icon on the second dot. After the player presses the button in the lower right hand corner, the sequence is sent to the doll's processor. As a result, the doll will first rotate counterclockwise, and then drive along the table following the direction of the line traced by the player and now in the app. After translating from the dot number one to the number two, the doll will execute the second command of 'arms up' to complete the simple routine.

Figure 4:
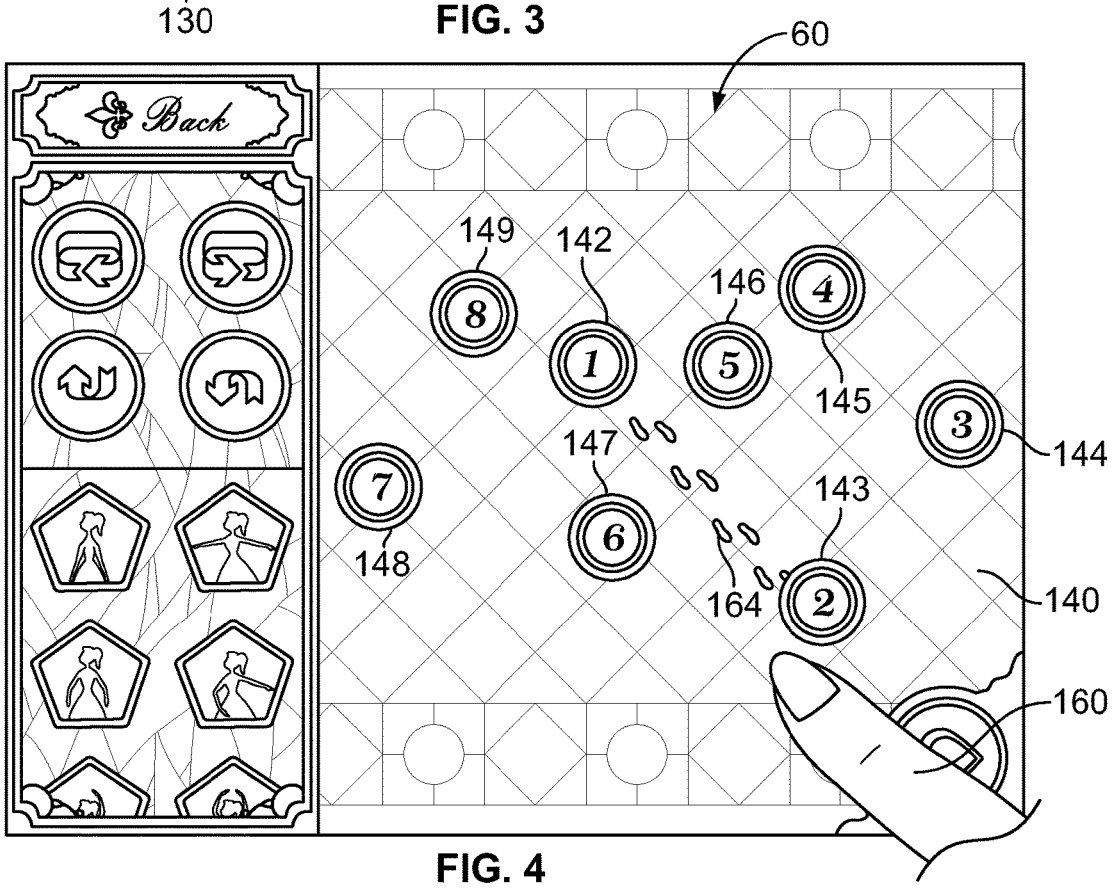
FIG. 4 is a plan view of the smart tablet computer that displays the dance step and arm movement input icons in the first region of the tablet and a finger of a player after inputting a planned movement of the doll between the number one dot and the number two dot.
Figure 5:
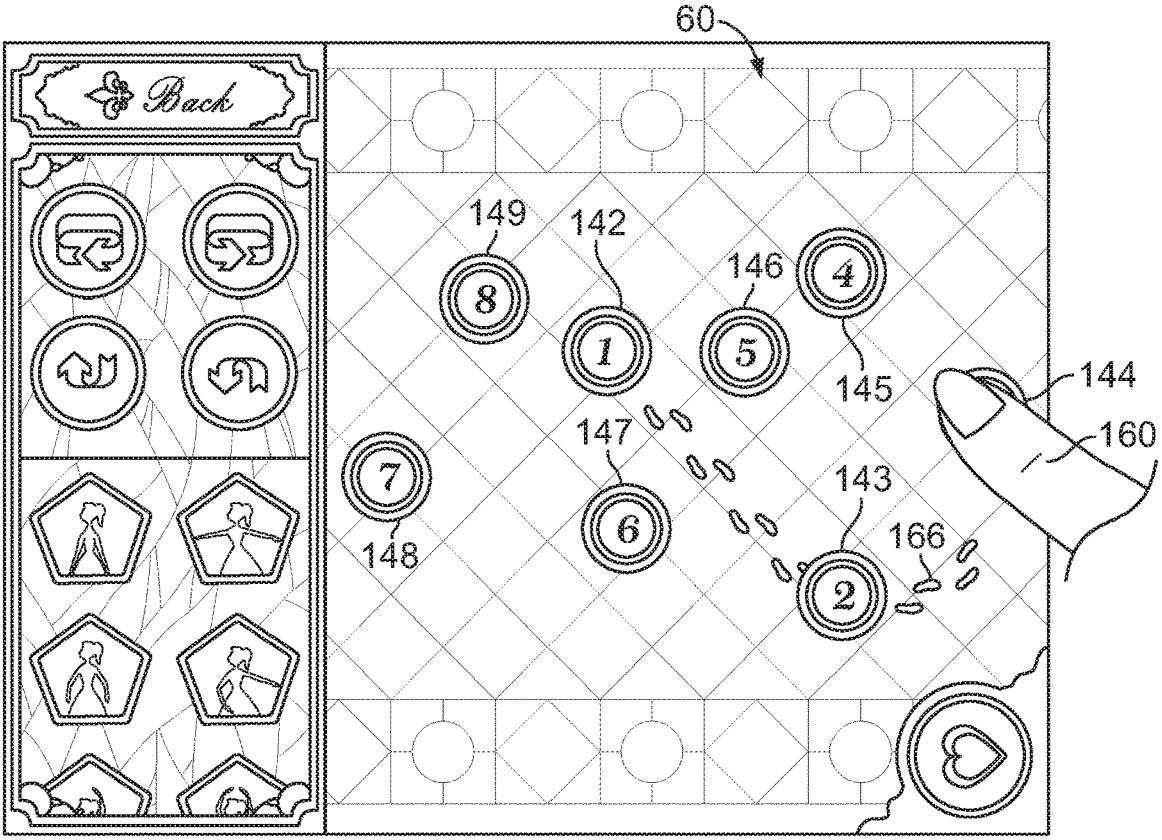
FIG. 5 is a plan view of the smart tablet computer that displays the dance step and arm movement input icons in the first region of the tablet and the finger of a player inputting a planned movement of the doll between the number two dot and the number three dot.
Figure 6:
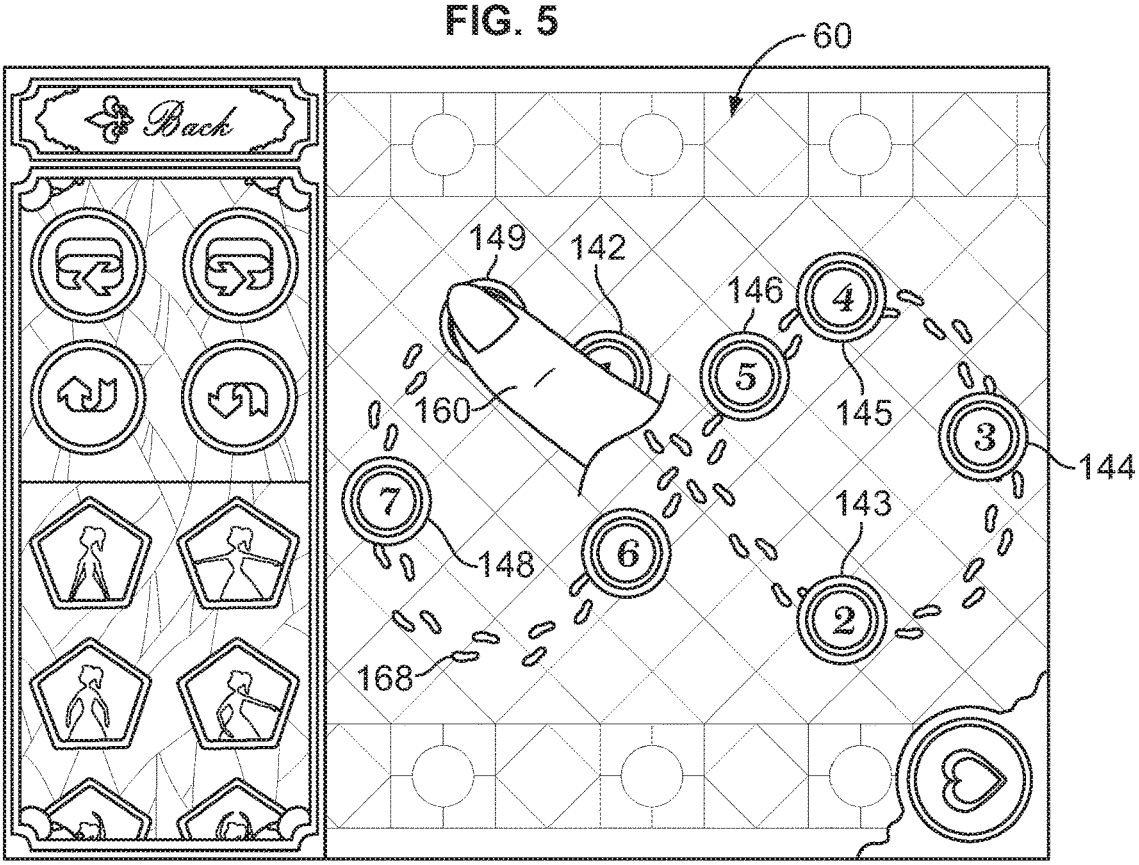
FIG. 6 is a plan view of the smart tablet computer that displays the dance step and arm movement input icons in the first region of the tablet and the finger of a player inputting a planned movement of the doll between the number seven dot and the number eight dot.
Figure 7:
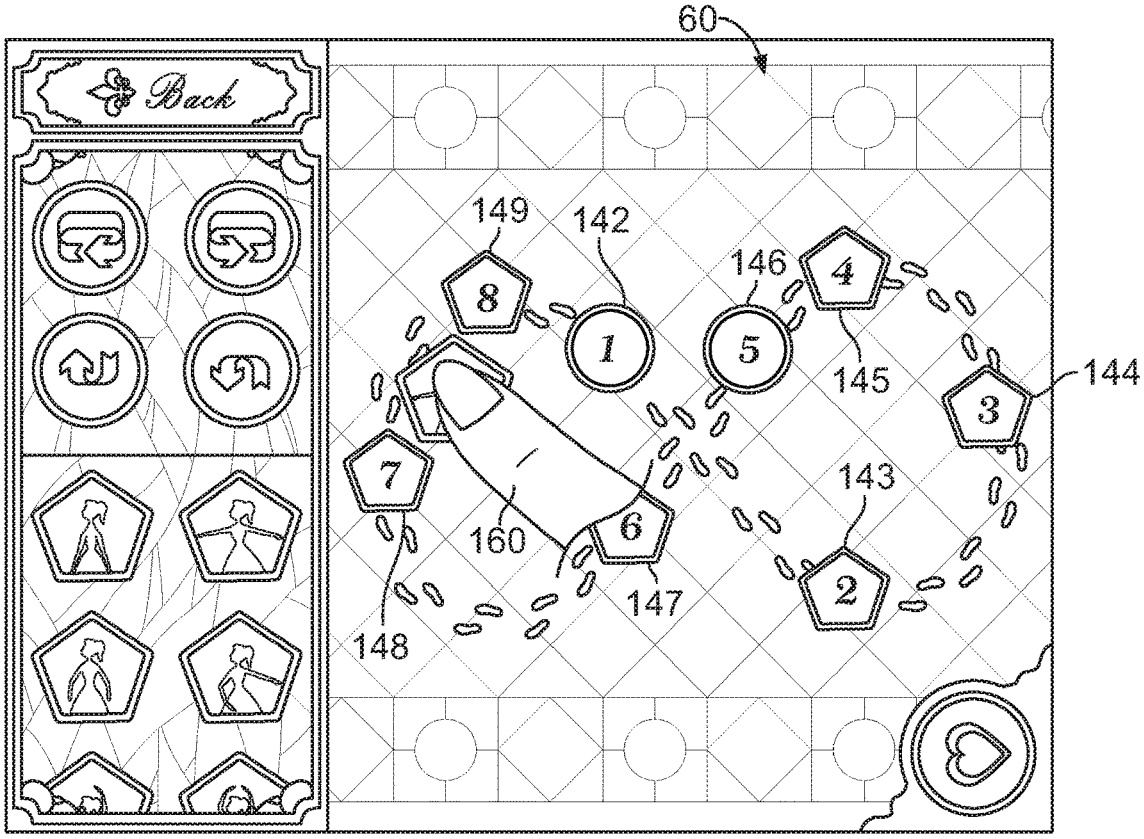
FIG. 7 is a plan view of the smart tablet computer that displays the dance step and arm movement input icons in the first region of the tablet and the finger of a player dragging an arm movement icon from the first region to the number eight dot in the second region, the dots having changed shape and/or color.
Figure 8:
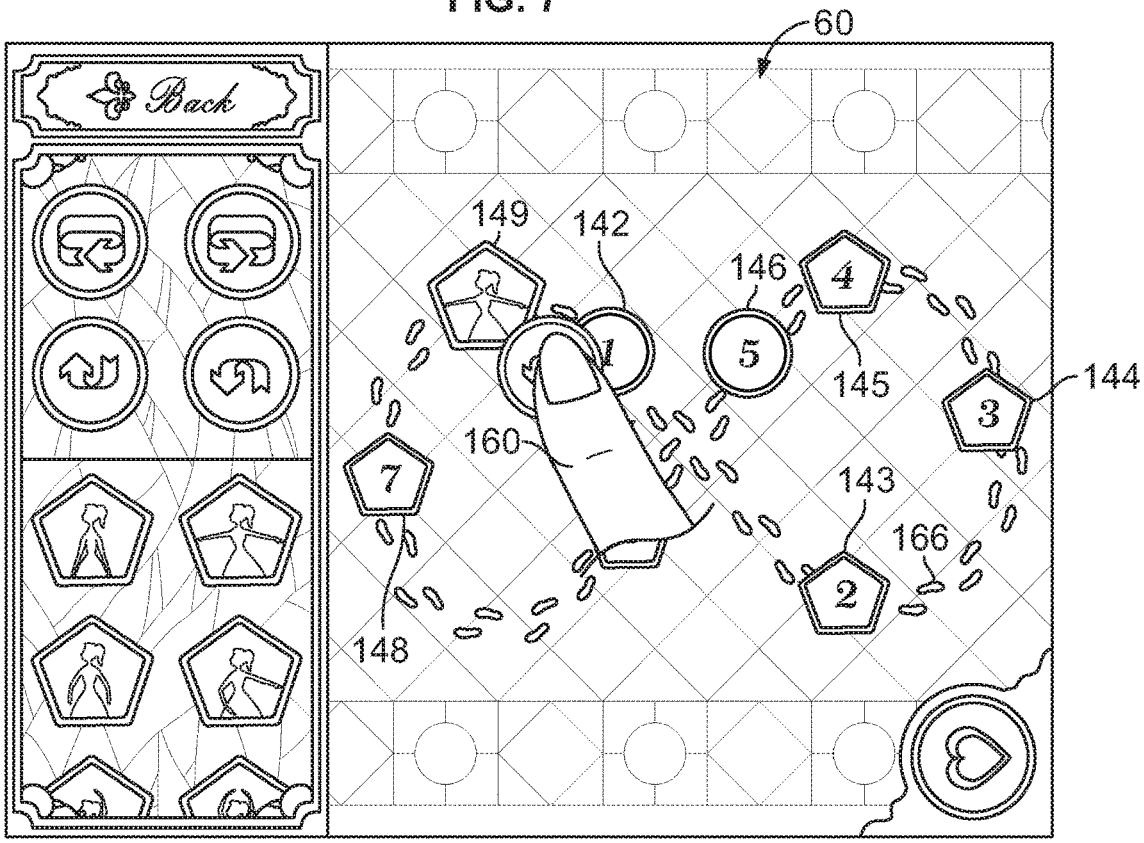
FIG. 8 is a plan view of the smart tablet computer that displays the dance step and arm movement input icons in the first region of the tablet and the finger of a player dragging a dance step icon from the first region to the number one dot in the second region.
Figure 9:
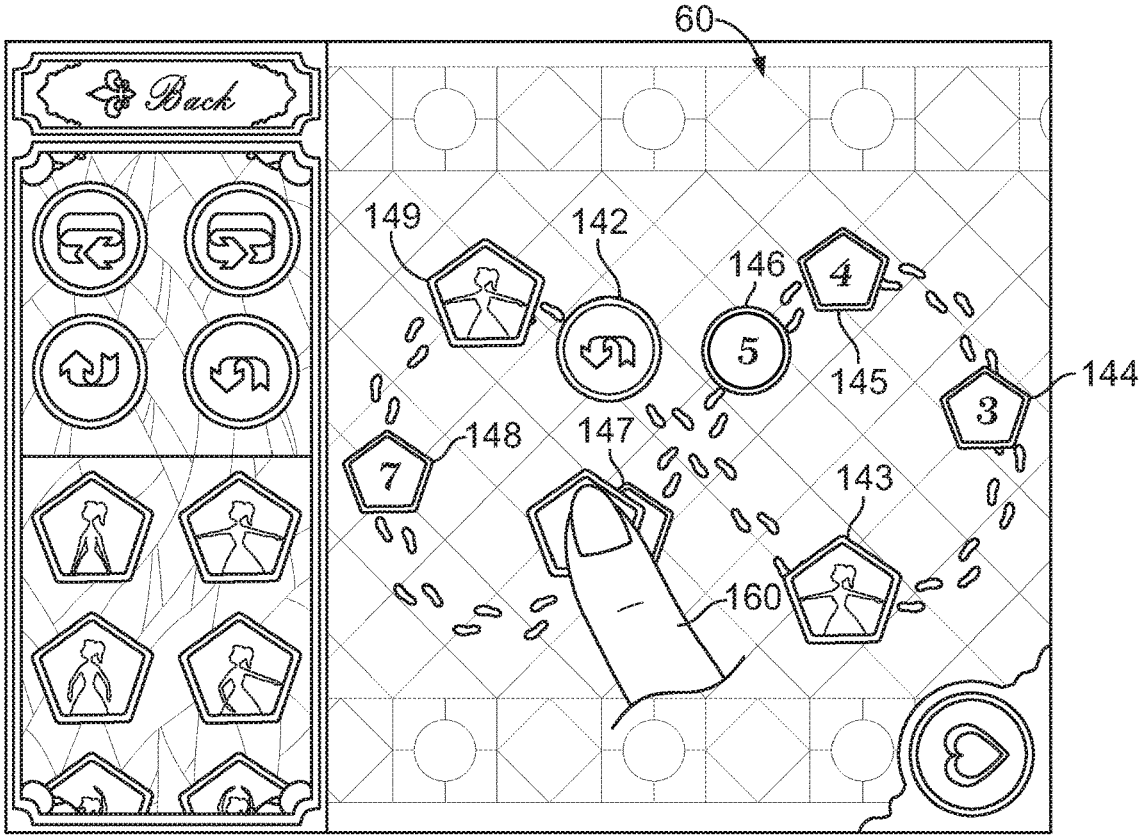
FIG. 9 is a plan view of the smart tablet computer that displays the dance step and arm movement input icons in the first region of the tablet and the finger of a player dragging an arm movement icon from the first region to the number six dot in the second region, the dot having changed shape.
Figure 10:
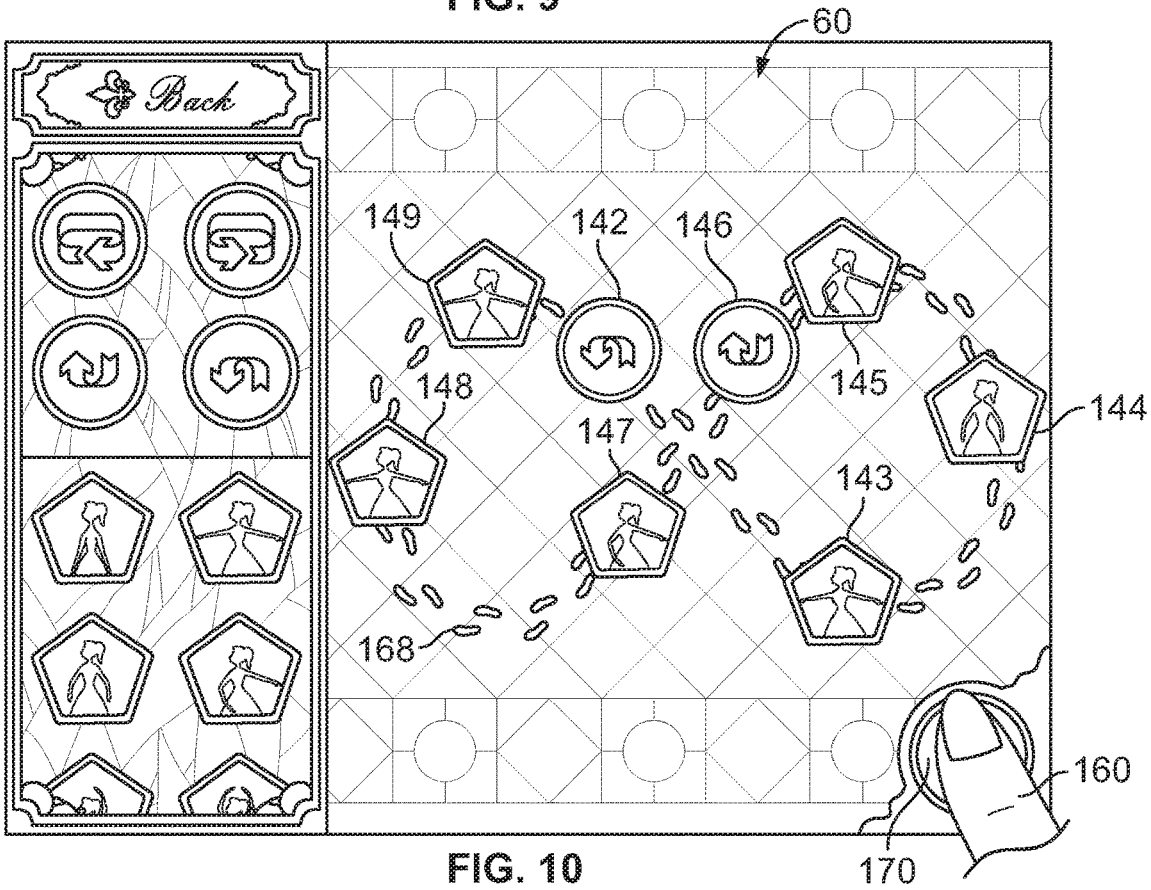
FIG. 10 is a plan view of the smart tablet computer that displays the dance step and arm movement input icons in the first region of the tablet and the finger of a player pressing a button to execute the dance steps shown by the dance step and arm movement icons dragged from the first region to the numbered dots in second region.

Referring back to FIG. 3, in play eight dots may be distributed in the second region 140 in a predetermined pattern. The player, as shown in FIG. 4, may then slide a finger 160 along a straight line, depicted as footprints 164, between the first dot 142, labeled number one, and the second dot 143, labeled number two, similar to the earlier example described above. Thereafter, the player, as shown in FIG. 5, may slide or drag her finger 160 in a curved line 166 between the second dot 143, labeled number two, and the third dot 144, labeled number three. The player may continue to slide her finger 160, FIG. 6, in straight and curved lines between each numbered dot in sequence. As shown in FIG. 6, the player has almost completed a figure eight path 168 using the eight dots on the display. Thereafter, the circular dots may change shape and/or color as shown in FIG. 7, to indicate to the player that each dot is ready to receive a dance step or a Belle icon having a matching peripheral shape. Once the dots' shapes/colors have changed the player may drag a dance step icon to the circular colored dots 142 and 146 and a pentagon shaped Belle icon to each of the transformed numbered color pentagons 143, 144, 145, 146, 147, 148, 149 as shown in FIGS. 7-9. When all of the numbered dots have been covered with dance step or Belle icons, the player presses a button 170, FIG. 10, at the lower right of the display 60 to send the sequence to the microprocessor 44, FIG. 19, mounted in the doll. The microprocessor 44 will instruct the doll to first rotate counterclockwise, then drive along the table in the straight line 164 generated by the player. After translation the doll will execute the second command of 'arms outward.' Next, the doll will move in a curve to the third dot 144 where the doll's arms are brought down. Thereafter, the doll will travel to the fourth, fifth, sixth, seventh, and eighth numbered dots 145, 146, 147, 148, 149 in numeral sequence along the figure-eight path 168 until the dance routine is concluded.

Figure 11:
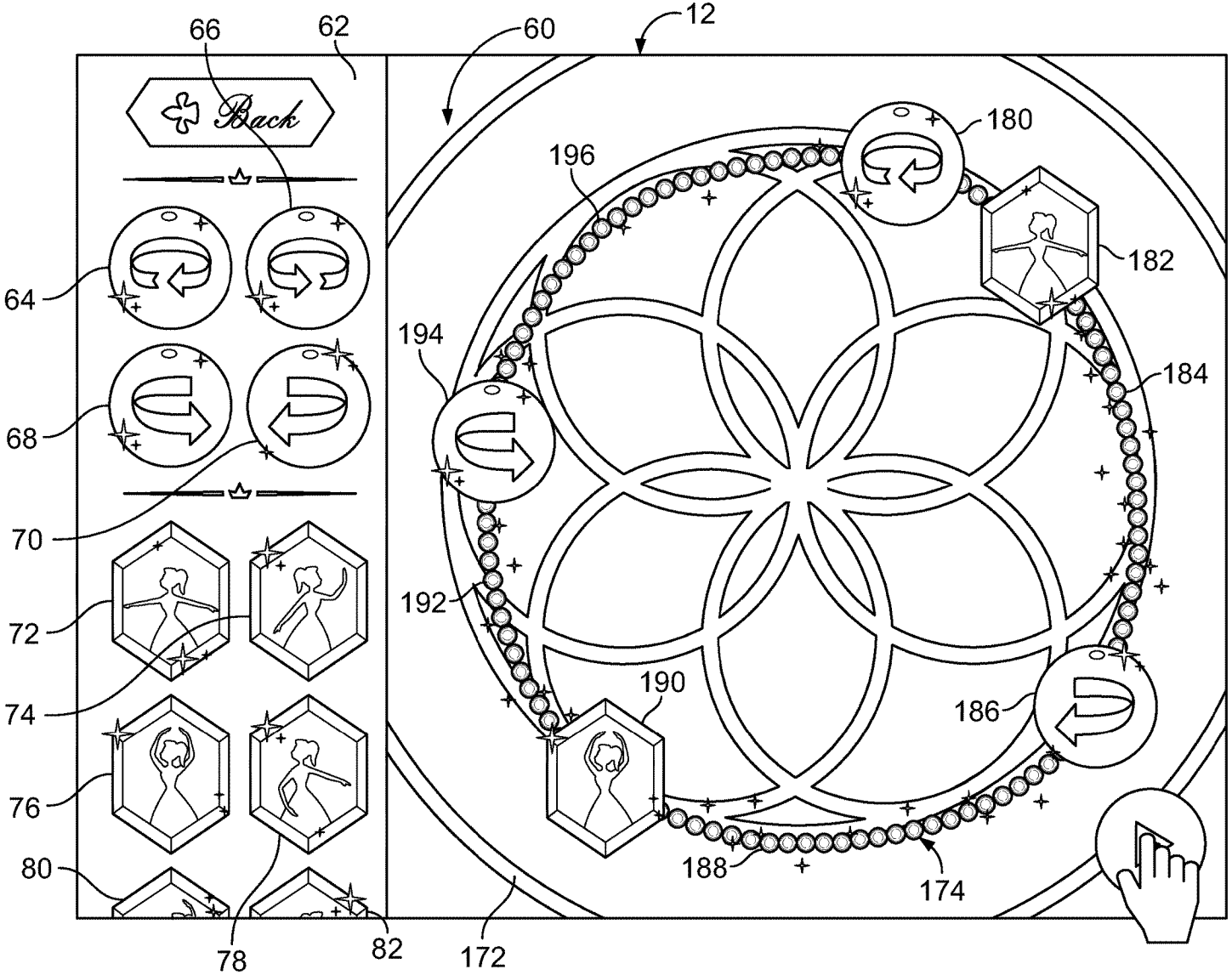
FIG. 11 is a plan view of the smart tablet computer that displays the dance step and arm movement input icons in the first region of the tablet and where the second region displays a circular pattern of dots with five dance step and arm movement icons that have been transferred from the first region.

It is understood that the selection display may differ widely and, in the alternative, icons may have different shapes (such as hexagons and octagons) and/or colors, the dot configurations may vary, as may the number of dots displayed. By way of further examples, reference is made to FIGS. 11 and 12 where the display 60 of the smart device 12 may include the same or a similar first region 62 with dance step and Belle icons, but the display of dots in the second region 172, FIG. 11, may be configured in a circular path 174 and in FIG. 12, as a two leaf-like path 176. With the circular pattern 174 in FIG. 11, the player-created program may start with the doll doing a clockwise twirl as shown by the dance step icon 180 near the top of the path followed by the doll lifting her arms up as instructed by first Belle icon 182. The doll then follow a curved arc 184 for almost 90° of the circular pattern 174 before moving in a right curve according to a second dance step icon 186 before moving in an arc 188 to the location shown by a second Belle icon 190 where the doll performs an arm-raised move. The doll continues along another arc 192 until reaching the location of a third dance icon 194 where the doll moves in a curve to the left. The doll then nearly completes the circular path 174 by moving in still another arc 196 to the location of the first dance step icon 180.

Figure 12:
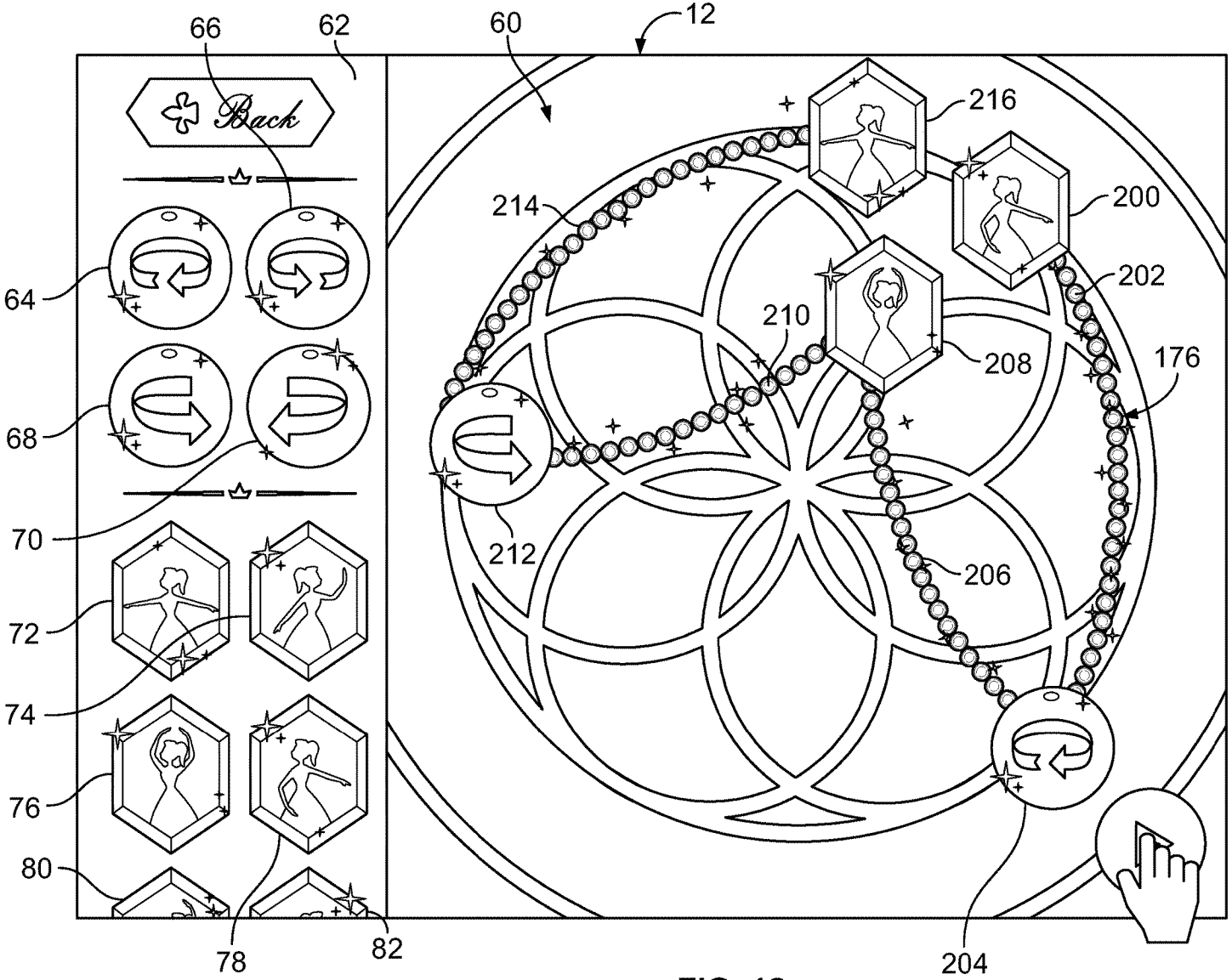
FIG. 12 is a plan view of the smart tablet computer that displays the dance step and arm movement input icons in the first region of the tablet and where the second region displays a two leaf-like pattern with five dance step and arm movement icons that have been transferred from the first region.

In FIG. 12, the app starts with a first Belle icon 200 where one arm is out and the other arm is bent. The doll then moves in downward arc 202 to a first dance step icon 204 where the doll rotates in the clockwise direction before the doll then moves in an upward arc 206 to a second Belle icon 208 where the doll raises her arms. The doll then follows a sideway arc 210 to a second dance step icon 212 at which the doll curves forward to the left. The final movement of the routine has the doll moving in a return arc 214 to a third Belle icon 216, very near to the first Belle icon 200. The third Belle icon 216 signals the doll to move her arms outward.

An additional game (not shown) may have Belle's processor choreograph her own dance routine from a preprogrammed app by the doll instructing a child operator to move selected icons from the first region of the display to the second region to set up a dance routine.

Figure 14:
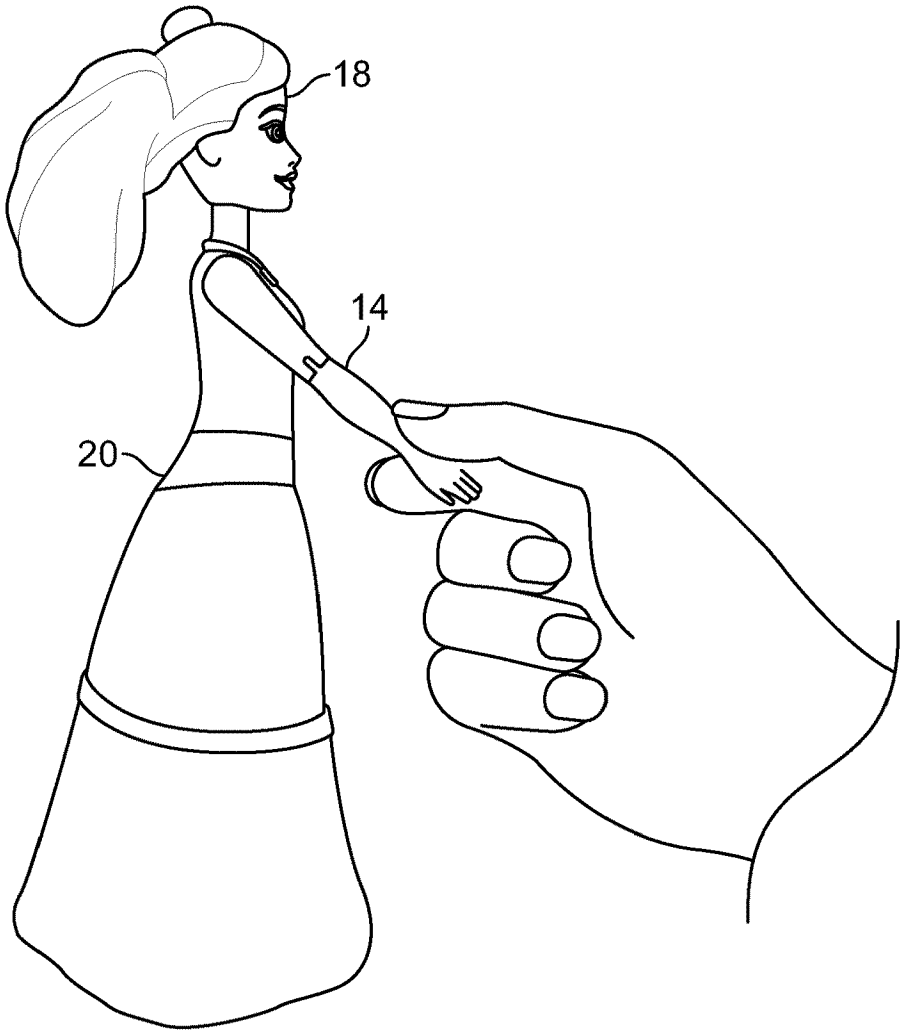
FIG. 14 is a side elevation view of the doll shown in FIG. 13, illustrating the right arm pulled by the player to a forward position.
Figure 13:
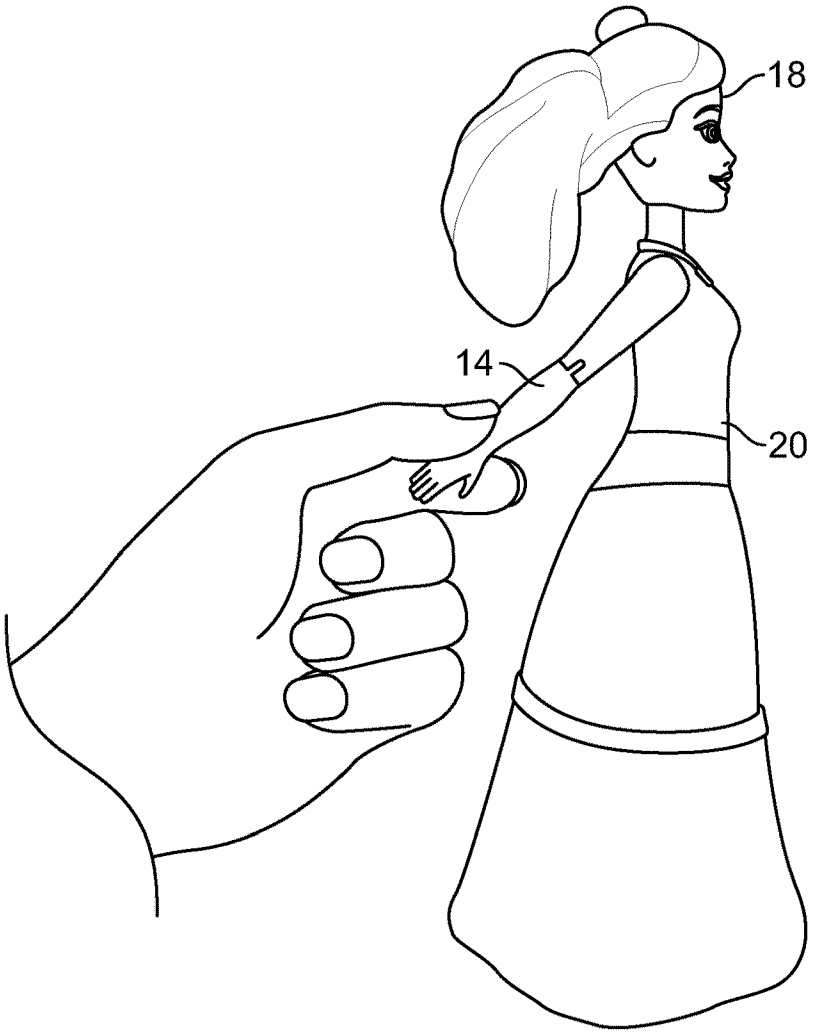
FIG. 13 is a side elevation view of the doll shown in FIG. 1, absent the doll's outer garments and illustrating a right arm pulled by the player to a rearward position.
Figure 16:
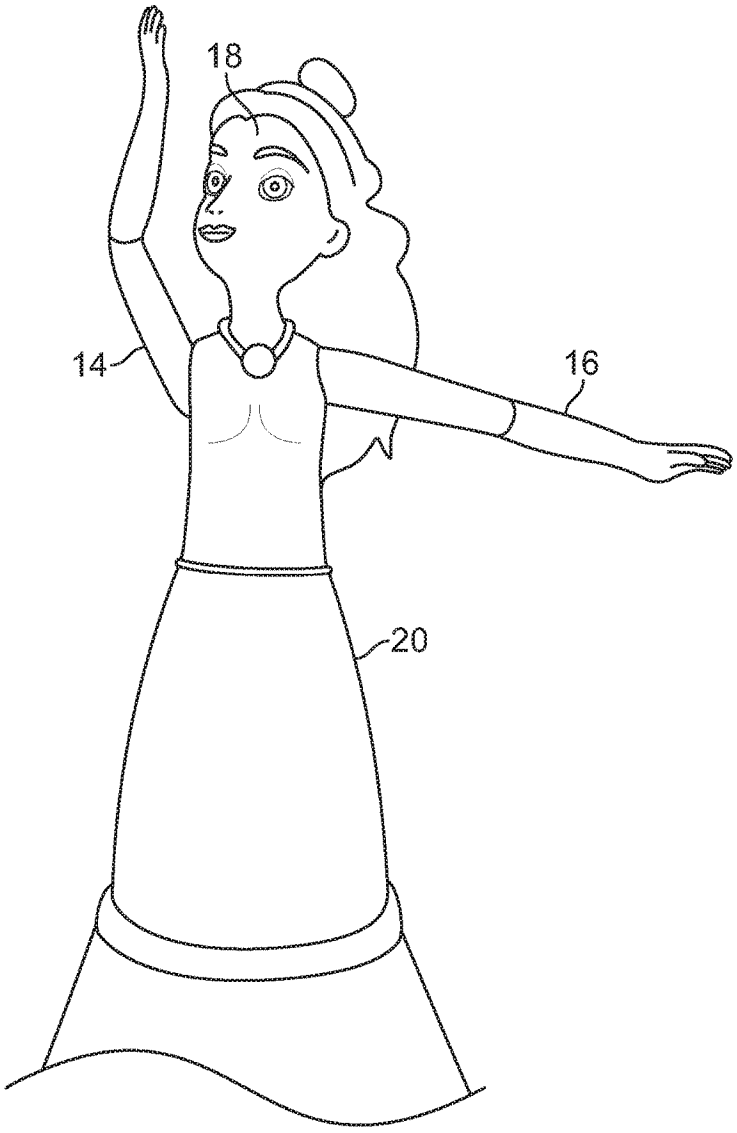
FIG. 16 is a front elevation view of the doll shown in FIGS. 13-15, illustrating other positions for the arms of the doll.

Illustrated in FIGS. 13-16, the arms 14, 16 of the doll may be manipulated by the child to move the doll in different ways as shown in FIGS. 13 and 14. Shown in FIG. 13, the right arm 14 is placed slightly rearward in relation to the doll's body 20, or forward as shown in FIG. 14. The motorized mechanisms in the doll may move the arms, the body and the head in different ways as, for example, in FIG. 15 where the right arm elbow is bent and in FIG. 16 where the left arm 16 is rotated outward, the right arm 14 is raised and the head 18 is rotated about 45° to the right.

In addition to arm movements, the doll may have codes and mechanisms for moving the doll's head to the left and/or to the right, as well as upward and down. The doll may also be pre-programed to play music, speak phrases and accept voice commands. Furthermore, the doll may be designed to detect music or singing and respond by dancing. Thus, the doll may respond to physical and audio inputs. If the doll is lifted up, the doll's motors may stop. If the doll is not moving, the child may move the doll's arms to lead the doll in a dance according to the arm movements mentioned above. The doll may also have a feature where it asks the child whether the child wishes to learn a dance, using such words as, "Would you like to learn a dance?" If no input is received for a predetermined period or if a voice input is the word "no," (assuming a microphone is provided) the doll may go to an idle state. A voice input such as a "yes," or a press of the button 22 or finger pressure on the screen of a smart device in response to the 'Learn to Dance' prompt may begin a dance routine.

Another feature may have the doll teach a dance, step-by-step, by demonstrating moves and then asking the child to try the step moves with the doll. The doll may repeat the dance process for each move in the dance. Once all of the moves have been demonstrated and practiced, the doll may ask the child to perform the dance with it by saying, "Let's perform the dance together!" The doll may then begin dancing to accompanying music while giving instructions, such as "Spin to the left," and offering encouragement, such as "You're doing great!" After the dance has been performed, the doll may praise the child and suggest performing the dance again, "That was great, let's perform it again!" or "Press my necklace to learn a different dance!" It is to be understood that many more features may be added to the doll, limited only by imagination and expense.

An important objective of the robot doll is to introduce the child to basic computer coding. The doll will allow the child to choreograph dances by placing 'dance move' blocks into a sequence as described above. When this sequence is played, the doll will perform the dance. This allows real-time choreography and will introduce the child to the idea of 'dance move' blocks.

Figure 18:
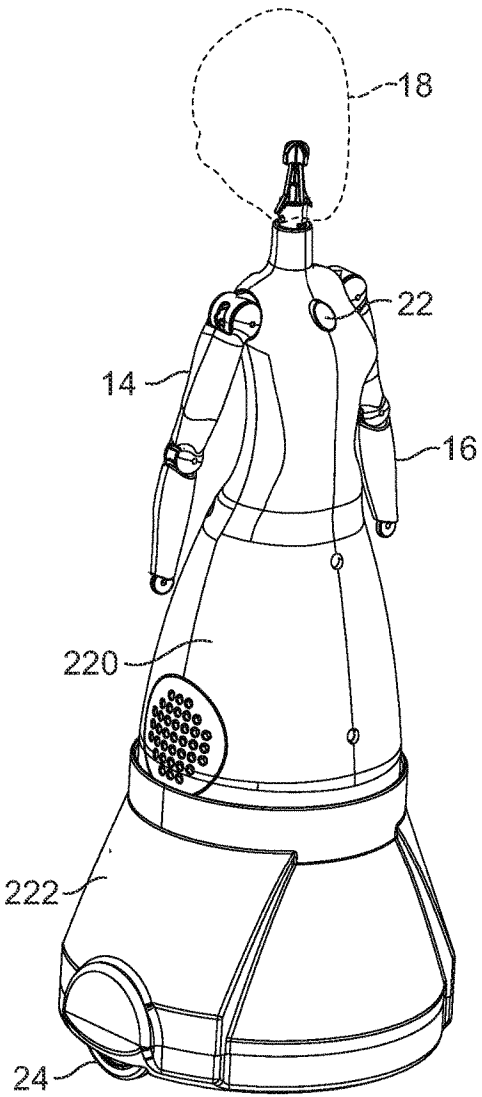
FIG. 18 is a isometric view of the doll shown in FIG. 17.
Figure 17:
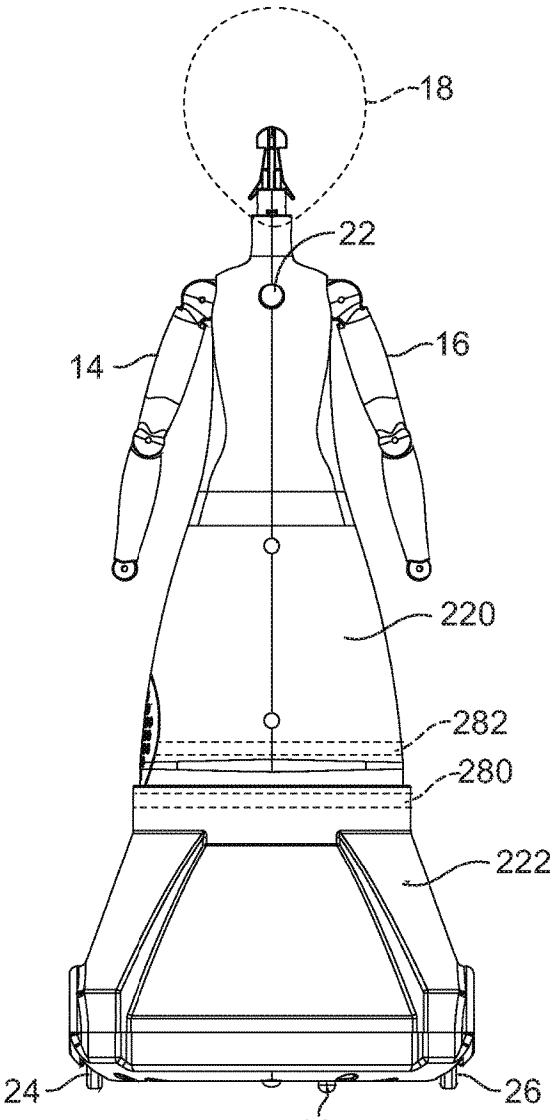
FIG. 17 is a front elevation view of the doll shown in FIGS. 1 and 13-16, with a head drawn in phantom lines and illustrating a lower outer shell portion and an upper outer shell portion.

To understand the underlying physical mechanisms of the doll, reference is made initially to FIGS. 17 and 18, where the doll is shown with a head 18 in dotted lines and with the doll's outer fabric removed. There is shown a plastic upper body portion in the form of an upper outer shell 220 and a plastic lower body portion or lower outer shell 222. An inner housing or frame (not shown) may be used to support various interior mechanisms. The shells are mounted to have the upper shell 220 move vertically, so as to selectively telescope into the lower shell 222, which does not move vertically. Mounted to the lower shell 222 are the right wheel 24 and the left wheel 26. In the alternative, the upper shell may telescope over the lower shell, and the shells may have different shapes, for example, the shells may simulate THE INCREDIBLE HULK® character or even a vehicle or other physical item.

Figure 20:
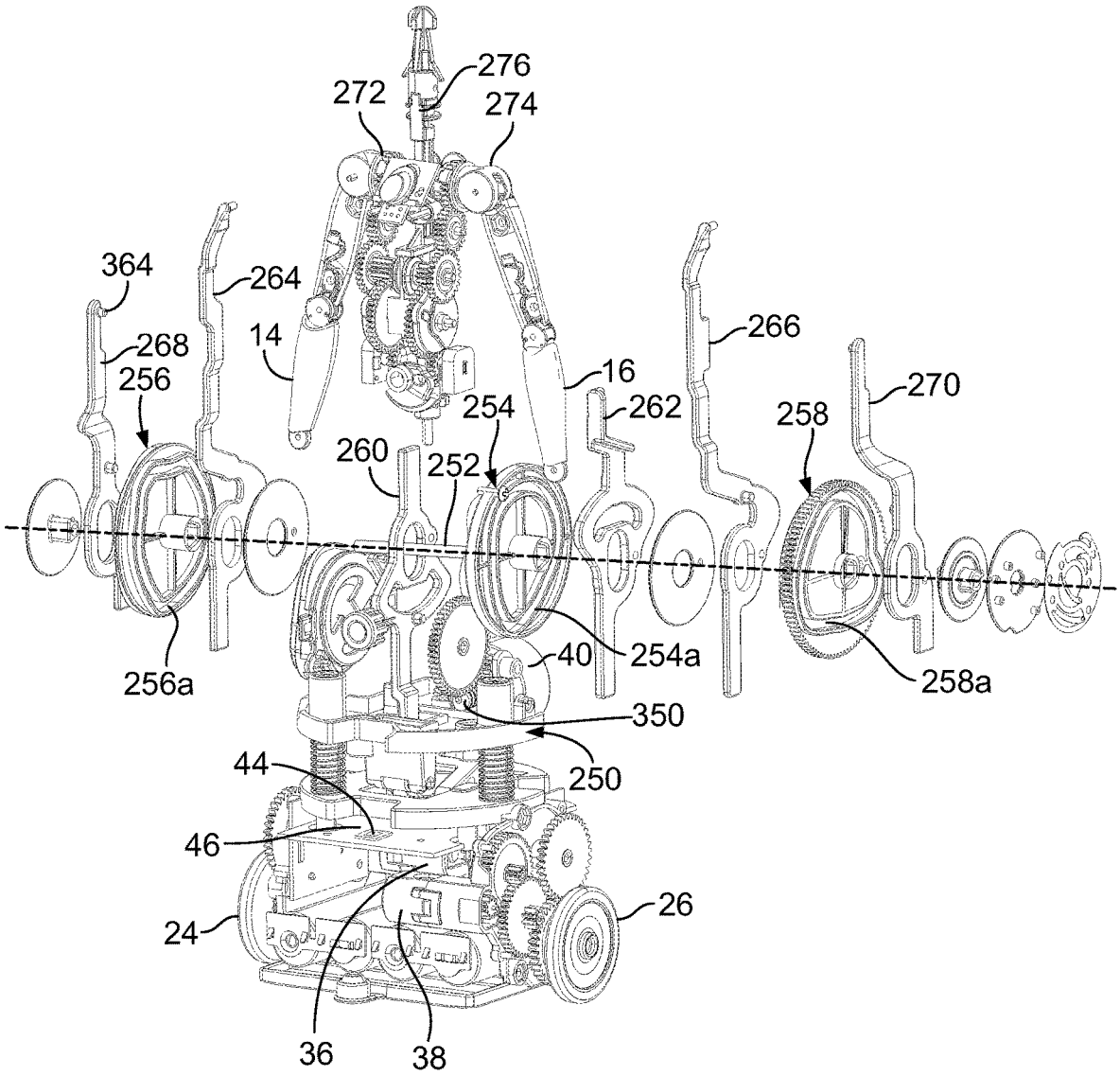
FIG. 20 is a partially exploded front isometric view of the doll's internal mechanisms shown in FIG. 19.
Figure 21:
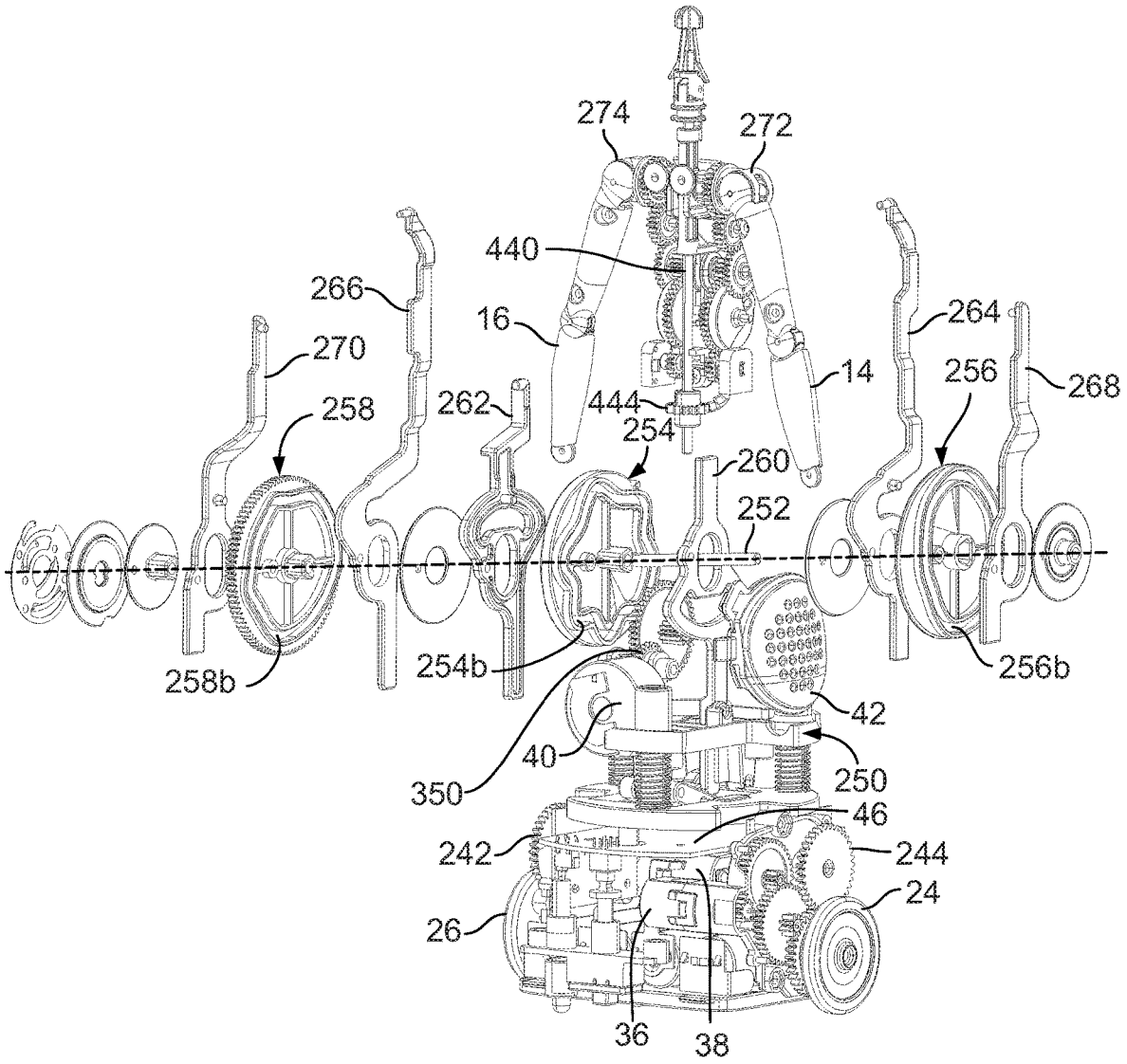
FIG. 21 is a rear isometric view of the partially exploded doll's internal mechanisms shown in FIG. 20.

Referring now to FIGS. 19-21, the left wheel motor 38, FIG. 19, is connected to rotate the left wheel 26, and the right wheel motor 36 is connected to rotate the right wheel 24. The wheel motors 36, 38 are reversible and may be placed above a battery compartment 230 having four batteries 232, 234, 236, 238. A battery door 240 encloses the battery compartment 230 at the bottom of the doll. A left gear train 242 connects the left wheel motor 38 with the left wheel 26, and a right gear train 244 connects the right wheel motor 36 with the right wheel 24. Above the wheels and the batteries is the pc board 46 to which is mounted the microprocessor 44. Above the pc board is a lowering or dipping mechanism 250, a main shaft 252, three rotatable cam mounted to the main shaft including a first or center cam 254, a second or right cam 256 and a third or left cam 258, a first cam follower 260, a second cam follower 262, a third cam follower 264, a fourth cam follower 266, a fifth cam follower 268 and a sixth cam follower 270, shoulder mechanisms 272, 274 and a head moving mechanism 276. The first cam 254 includes a first or left side cam surface 254*a* and a second or right side cam surface 254*b*. The second cam 256 includes a third or left side cam surface 256*a* and a fourth or right side cam surface 256*b*. The third cam 258 includes a fifth or left side cam surface 258*a* and a sixth or right side cam surface 258*b*.

Figure 24:
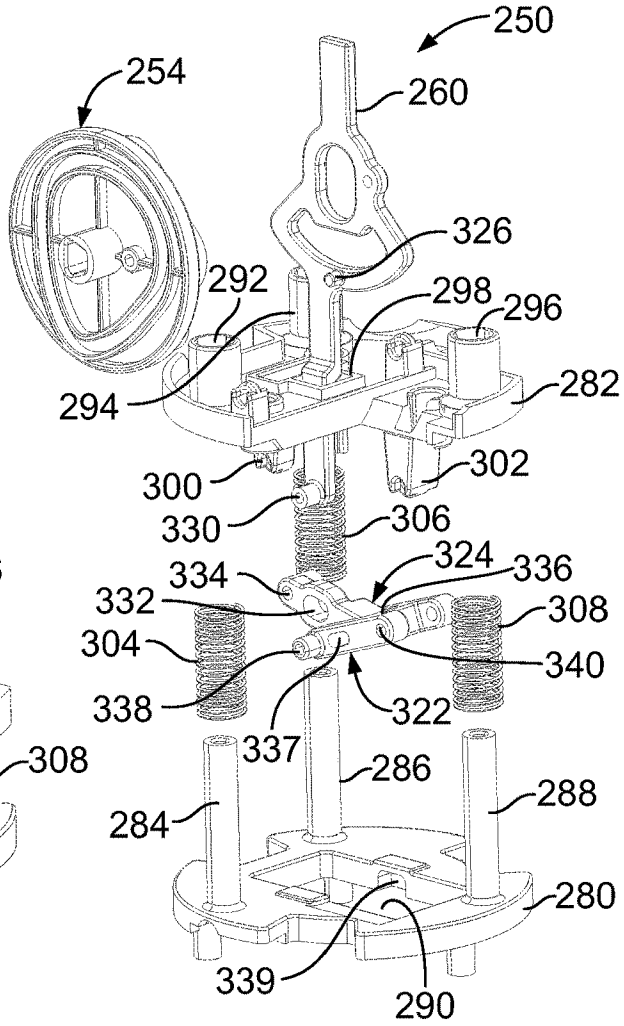
FIG. 24 is a fully exploded isometric view of the mechanism shown in FIG. 23.
Figure 23:
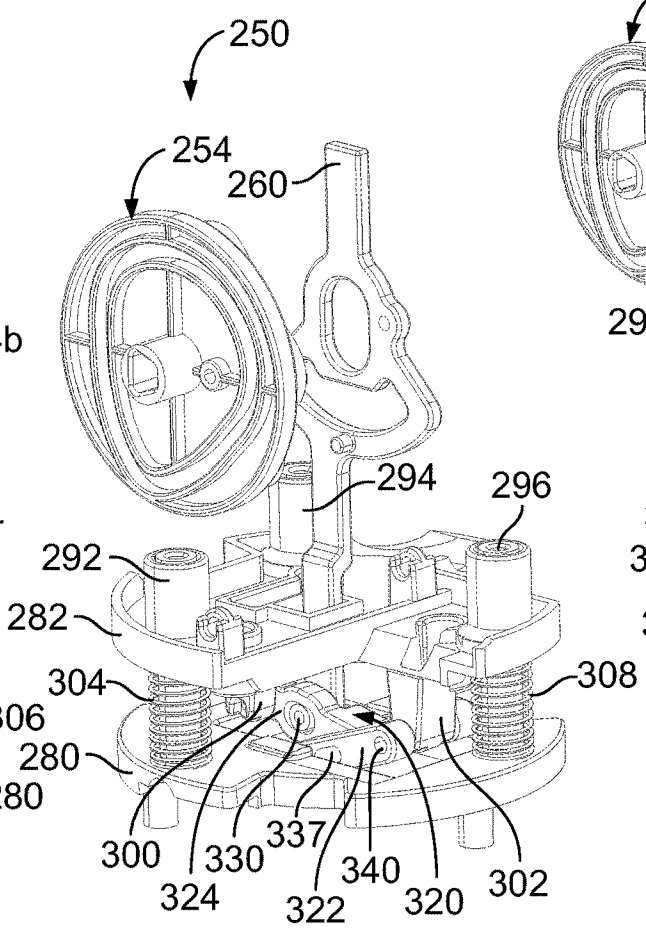
FIG. 23 is a left side isometric view, partially exploded, of the mechanism shown in FIG. 22.
Figure 22:
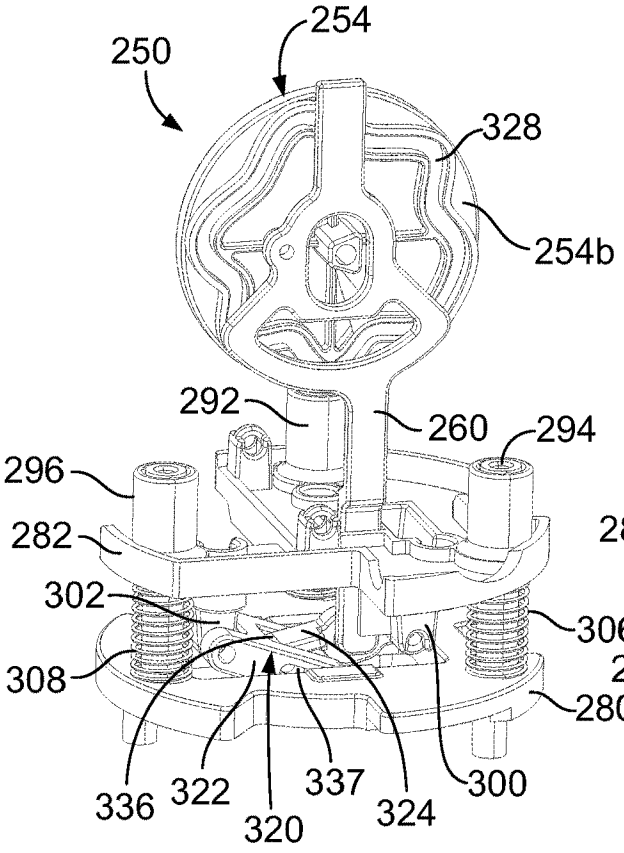
FIG. 22 is a right side isometric view of a mechanism for moving the upper portion of the doll shown in FIG. 1, in a vertical direction.

An important feature of the present invention is the simple yet robust dipping mechanism 250. The dipping mechanism includes a first or lower platform 280, FIGS. 22-24, connected to a housing (not shown) in a fixed position within the lower shell 222 and a second or upper platform 282 that is spaced from the lower platform and vertically movable. The lower platform 280 may include three integral spring mounting posts 284, 286, 288, FIG. 24, and a central opening 290. The upper platform 282 may include three spring caps 292, 294, 296, a central opening 298 and two linkage mounts 300, 302. Three compression springs 304, 306, 308, each mounted around one of the spring posts 284, 286 288, are captured between the lower platform 280 and a corresponding one of the spring caps 292, 294, 296. The springs are used to counter the force of gravity by boosting the upper platform upward along with the cam 254 and the cam follower 260. The platforms and springs are elegant structures, robust and cost effective for returning the upper platform upward, although the springs may not be required, if desired. A linkage 320 having two pivotal links 322, 324 are mounted to the linkage mounts 300, 302 and extends into the central opening 290 of the lower platform. The dipping mechanism includes and is operated by the second cam surface 254*b* of the center cam 254 and the downward extending first cam follower 260. The first cam follower 260 includes a finger 326 that engages a circular undulating raceway 328 of the second cam surface 254*b* to move along the raceway as the center cam rotates.

Figure 24A:
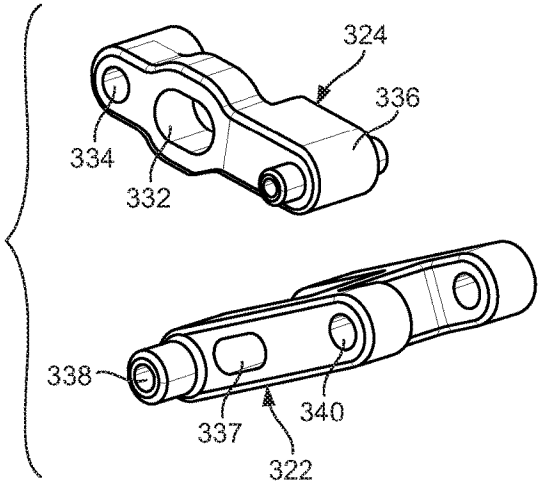
FIG. 24A is an enlarged, exploded isometric view of a linkage in the mechanism shown in FIGS. 22-24.

At the lower end of the first cam follower 260 is a short shaft 330 that is received by a middle opening 332, FIG. 24A, in the middle of the second link 324. The second link 324 is pivotally connected at one end 334 to the linkage mount 300, FIGS. 22-24, of the upper platform 282 and at another end 336 to a slot-like opening 337 in the first link 322. One end 338 of the first link 322 is mounted in a slot 339 in the lower platform 280. An opposite end 340 of the first link 322 is pivotally connected to the linkage mount 302. Rotational movement of the center cam 254 translates into vertical motion of the first cam follower 260 and movement of the linkage 320. When the upper platform 282 is lowered the springs 304, 306, 308 are compressed and when the upper platform is raised the compressed springs assist in lifting the upper platform. As mentioned, the dipping mechanism is simple yet robust as well as being compact and cost effective.

In operation, rotation of the center cam 254 causes the first cam follower 260 to follow the raceway 328 on the cam surface 254*b* resulting in the first cam follower 260 being enabled to move upward and downward. The vertical movement is transmitted to the linkage 320 and the upper platform 282 causing the upper platform 282 and the upper shell 220 to also move in a vertical direction. When a ball gown is covering the body 20 as shown in FIG. 1, the vertical movement of the upper shell appears to simulate the doll bending at the knees such that when the doll is rolling on the wheels 24, 26, the appearance is that of the doll stepping along a dance floor performing a dance routine. When the arms, the head and the wheels are also moving together in a predetermined sequence, the appearance to the child is one of Belle moving gracefully and beautifully in performance on the table.

In the alternative, more or fewer springs may be used, or no springs at all, if desired, and a linkage may be arranged differently.

The cam drive motor 40, FIGS. 19 and 21, rotates the third cam 258, which is mounted to the camshaft 252 by way of a gear train 350. The camshaft 252 also rotates the center and the right cams 254, 256. The center cam 254 includes the first cam surface 254*a*, FIG. 20, for engaging the second cam follower 262. These are opposite the second cam surface 254*b* that engages and operates the first cam follower 260. The left cam 258 includes the fifth and sixth cam surfaces 258*a* and 258*b*, FIGS. 20 and 21, respectively, where the fifth cam surface 258*a* engages and operates the sixth cam follower 270, and the sixth cam surface 258*b* engages and operates the fourth cam follower 266. The right side cam 256 includes the third and the fourth cam surfaces 256*a* and 256*b* where the fourth cam surface 256*a* engages and operates the third cam follower 264, and the fifth cam surface 256*b* engages and operates the fifth cam follower 268. Each cam surface includes a raceway having a predetermine shape to control the vertical movement of its corresponding cam follower.

Figure 26:
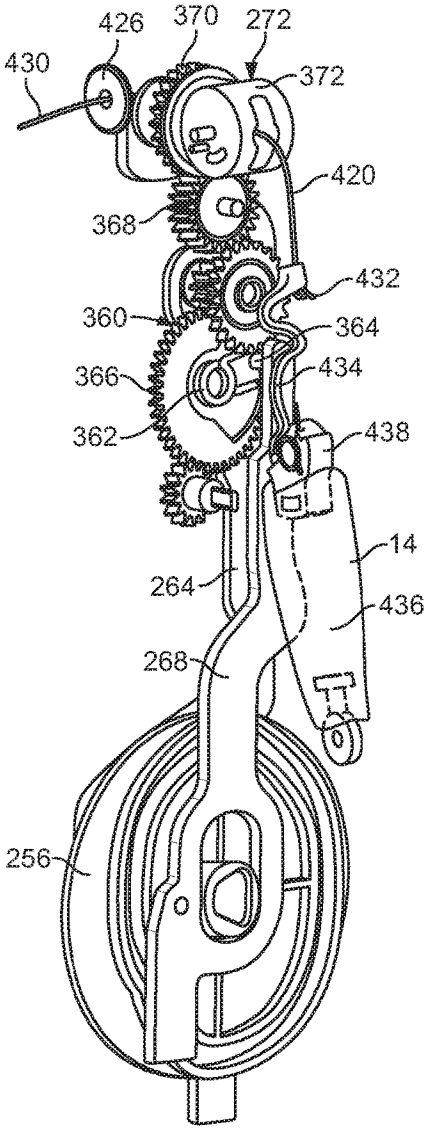
FIG. 26 is a right rear isometric view of the right arm mechanism shown in FIG. 25.
Figure 25:
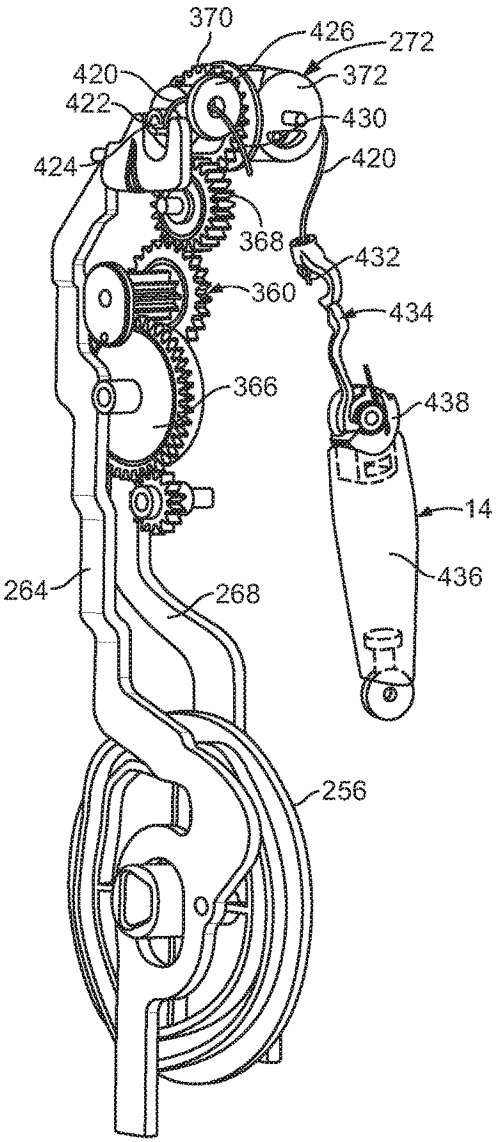
FIG. 25 is a left rear isometric view of a right arm mechanism.

Movement of the outer fifth and sixth cam followers 268 and 270 causes the right and left arms 14, 16 to rotate forward. Referring now to FIGS. 25 and 26, the fifth cam follower 268 engages a gear train 360 from between end arms of a torsion spring 362 where a short post 364 at the end of the cam follower 268 engages a lower gear 366. The gear train 360 continues up to an upper gear 368 that engages a right shoulder gear 370 of the right should 272 to rotate a right shoulder cap 372 around a first, generally horizontal axis 374, FIG. 27. In a similar manner, the sixth cam follower 270 engages a gear train 380 from a lower gear 382 to an upper gear 384 that engages a left shoulder gear 386 of the left shoulder 274 to rotate a left shoulder cap 388 around the first horizontal axis 374.

Figure 27:
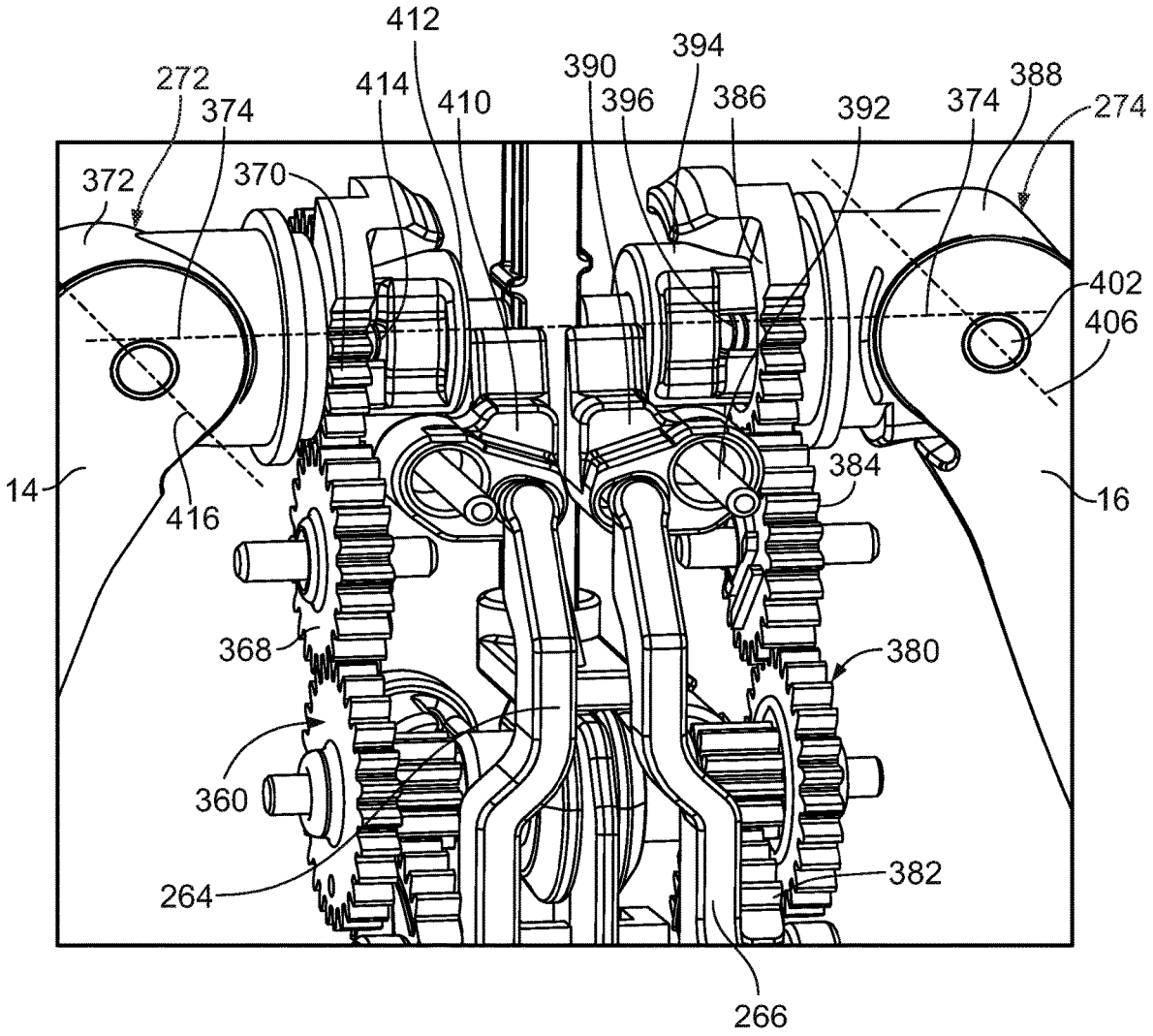
FIG. 27 is an enlarged front isometric view of the shoulder mechanisms of the doll shown in FIG. 19.
Figure 28:
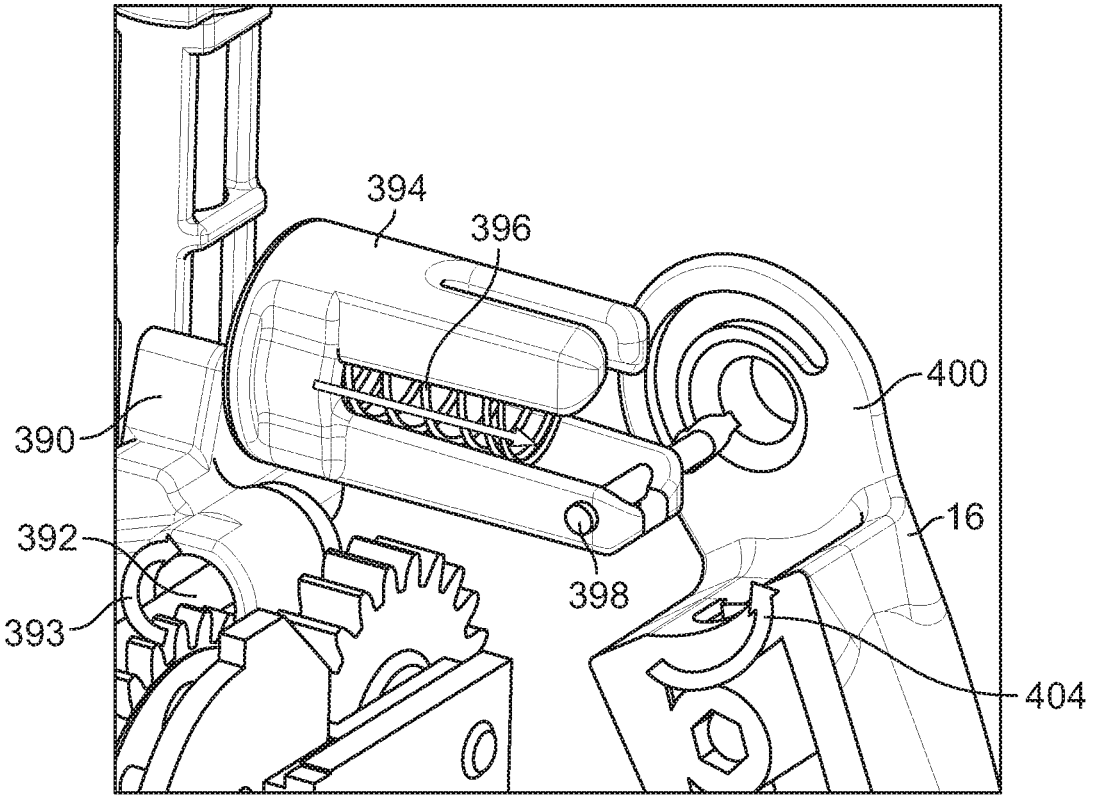
FIG. 28 is an enlarged, front isometric view of a portion of the left shoulder mechanism shown in FIG. 27.

The right and left cams 256, 258, the cam surfaces 256*a*, 258*b*, and the long, third and fourth cam followers 264, 266 cause the arms 14, 16 to rotate away or outward from the body 20. Referring to FIG. 27, the fourth cam follower 266 engages a pivotal lever 390 near the left shoulder cap 388 such that when the cam follower 266 moves upward the lever 390 rotates clockwise around a shaft 392, as symbolized by an arrow 393, to move a cylindrical plunger 394 toward the shoulder cap 388 while compressing a spring 396. The plunger 394 also abuts a post 398, FIG. 28 that is attached to the left arm 16. The post 398 may be attached to an arm frame 400 that is mounted to the shoulder cap 388 so as to rotate around a shaft 402, FIG. 27, as symbolized by an arrow 404, FIG. 28, and a second generally horizontal axis 406, FIG. 27, that is generally perpendicular to the first horizontal axis 374.

The third cam follower 264 engages a lever 410 near the right shoulder cap 372 such that when the third cam follower 264 moves upward, the lever 410 rotates counterclockwise causing a cylindrical plunger 412 to bear against a post (not shown, but a mirror image of the post 398) and compress a spring 414. The post is attached to the right arm 14. Like with the left arm, the post may bear against an arm frame (not shown) that is mounted to the right shoulder cap 372 so as to rotate the arm 14 around a third, generally horizontal, right shoulder axis 416. The right shoulder axis 416 is generally perpendicular to the first horizontal axis 374 and parallel to the left shoulder axis 406 as shown in FIG. 27.

It is noted that FIGS. 25-32, may show some of the same components but appear at variance because elements not relevant for a specific view have been removed to enhance clarity.

Figure 15:
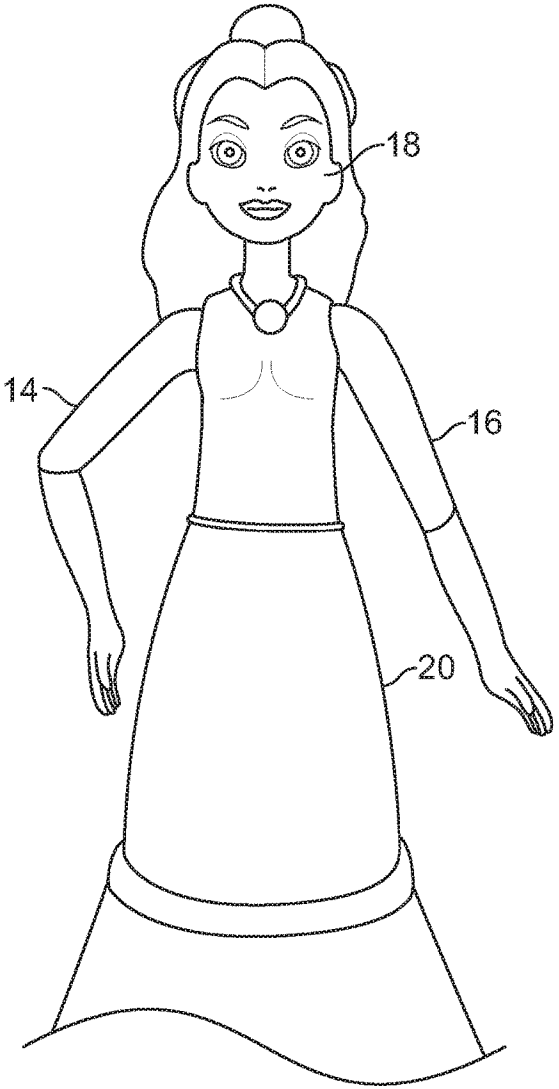
FIG. 15 is a front elevation view of the doll shown in FIGS. 13 and 14, illustrating the right arm in an elbow-bent position.
Figure 29:
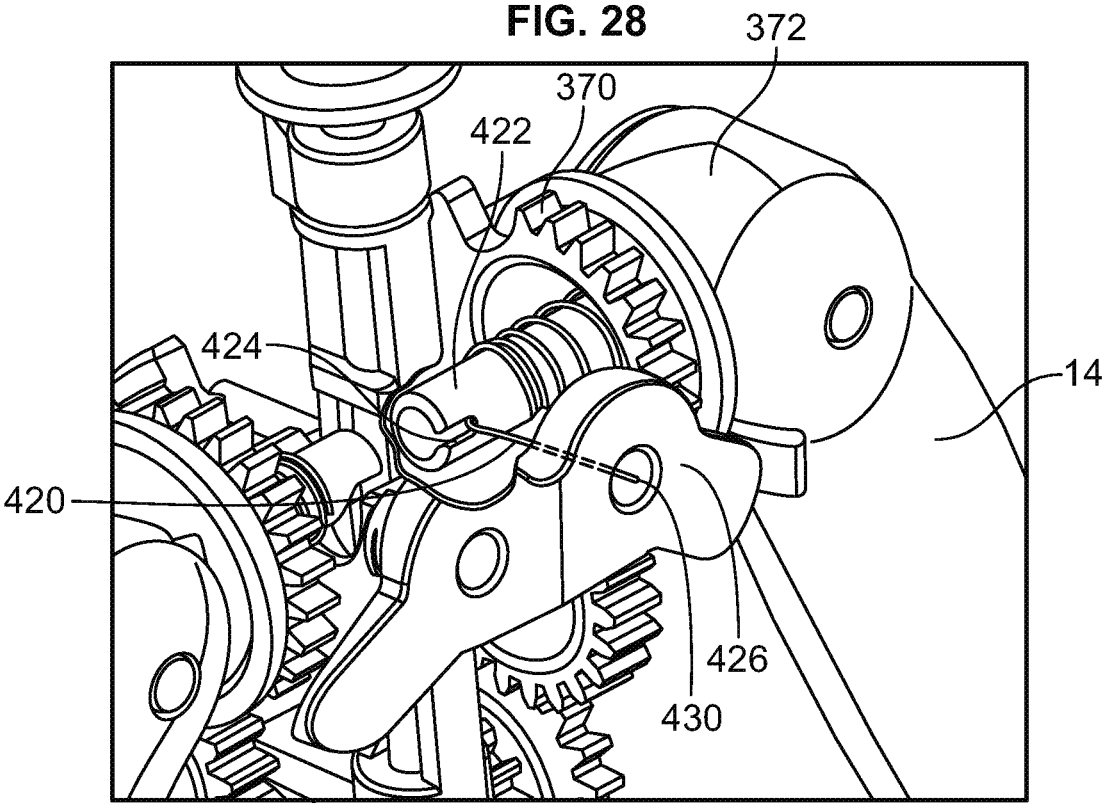
FIG. 29 is an enlarged rear isometric view of the shoulder mechanisms shown in FIG. 27.

When one of the arms 14, 16 is rotated forward an internally placed string, such as the string 420, FIGS. 25, 26 and 29, causes the arm to bend at an elbow. For example, focusing on the right shoulder 372 and the right arm 14, a tube 422, FIGS. 25 and 29, has a notch 424 near a string lock 426 that is located at the back of the doll. The tube 422 rotates with the right shoulder gear 370. One end 430 of the string 420 is attached to the string lock 426 and the remainder of the string extends to the shoulder 372 and down the right arm 14 to attach at an opposite end 432 to a convoluted, breakage-protector spring 434, FIGS. 25 and 26. The protector spring 434 extends to and is connected to a lower arm portion 436 by an elbow bracket 438. When the arm 14 is rotated forward, the string tightens around the tube 422 because of the placement of the notch 424. The tightening causes a greater tension in the string 420 which is transmitted to the protector spring 434 and the bracket 438 causing the lower arm portion 436 to be raised and bend at the elbow, such as shown in FIG. 15. However, should the child attempt to straighten the arm, the protector spring 434 will stretch until the child-induced straightening force is released allowing the protector spring to snap back and resume its original shape. There is another string (not shown) for the left arm 16 and components that are a mirror image of the components described for the right arm. The left arm operates in the same manner as that described for the right arm.

The protector spring is made from a medium viscosity polymer (85%) having a generic name of polyacetal, and Delrin 100ST (15%). In operation, the protector springs are generally rigid under a given low load which allows them to raise the lower arms, but the springs plastically deform when over-loaded, such as when a child tries to straighten an arm. As stated, once the over-load is released the spring returns to its original shape.

Figure 30:
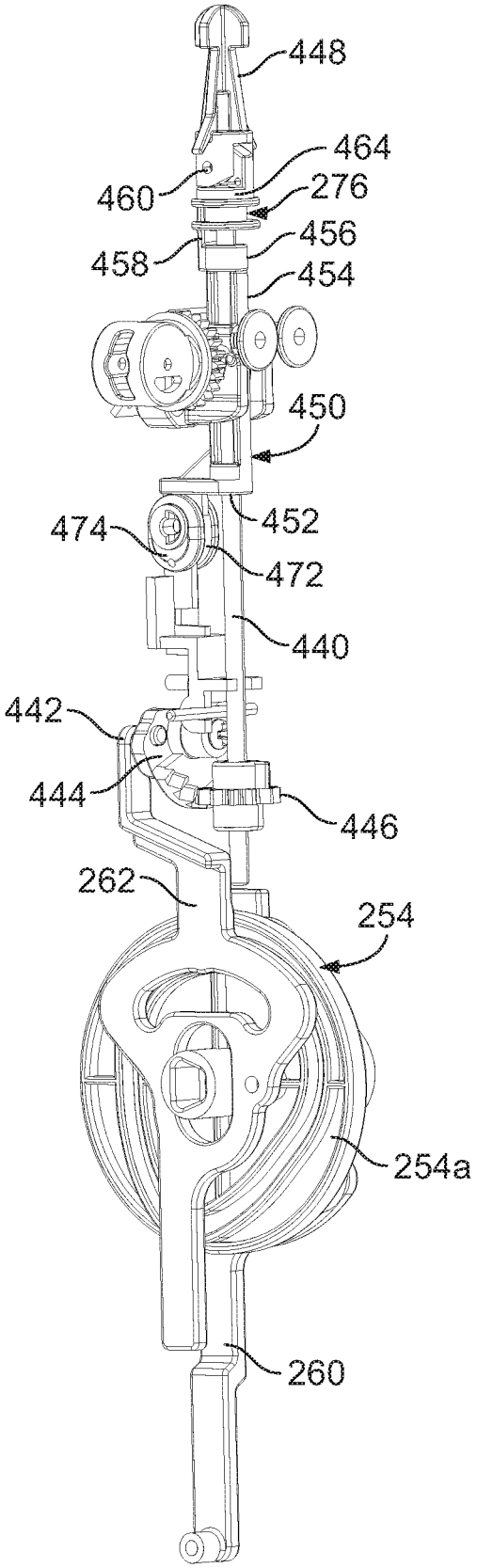
FIG. 30 is a left rear isometric view of a mechanism for moving the head of the doll shown in FIG. 1, from side to side and up and down.
Figure 31:
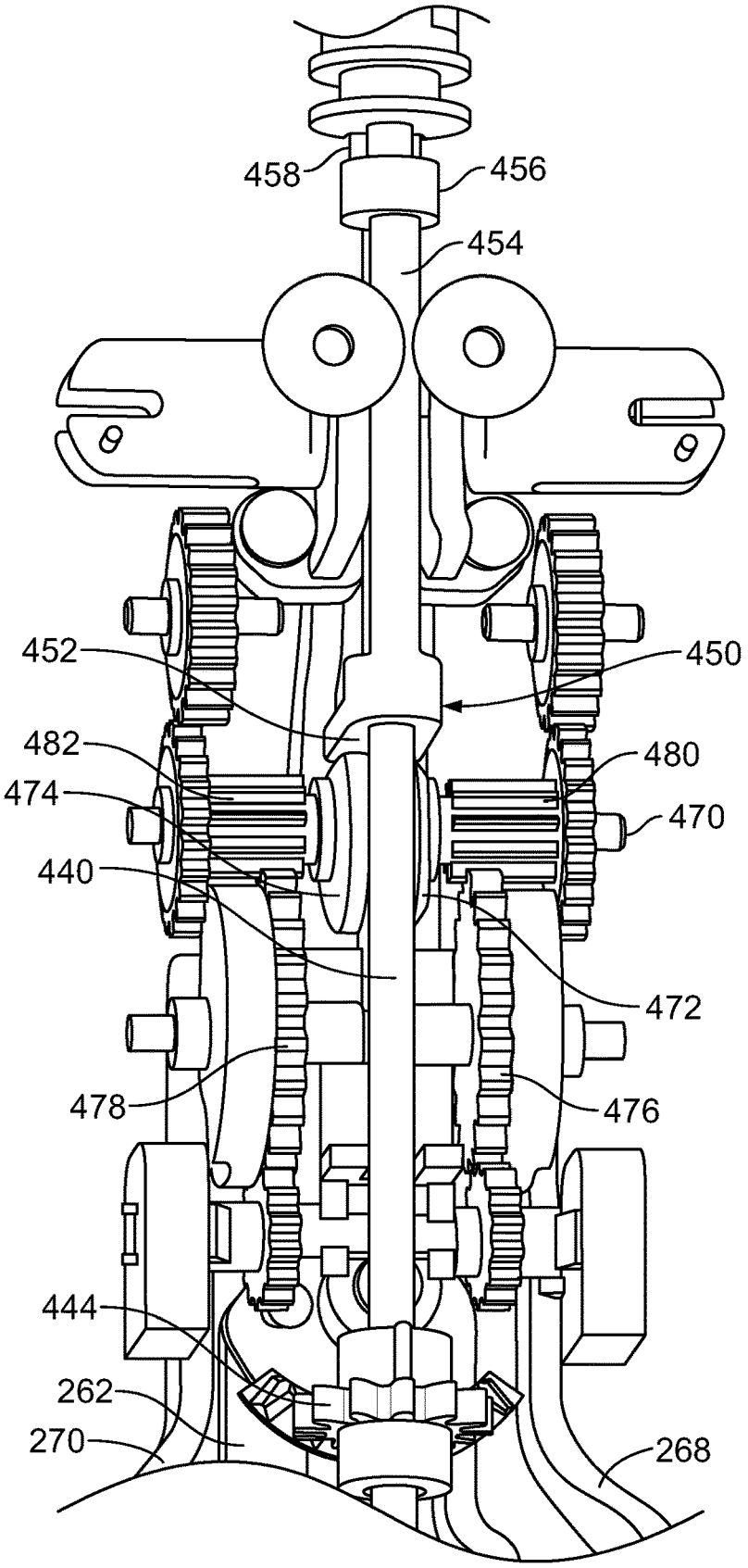
FIG. 31 is an enlarged rear isometric view illustrating cams for pivoting the head up and down.

The doll robot may also include a spine-like rod 440, FIGS. 30 and 31, extending along the back of the doll for causing the head to rotate left and right and to facilitate head movement upward and then allowing the head to return to its original position. The cam 254 includes the cam surface 254*a* to cause left and right swinging of the head. The cam surface 254*a* operates the second cam follower 262 in a vertical direction. A top end 442 of the cam follower 262 is connected off-center to a miter gear assembly 444 that includes a spur gear 446 mounted around the rod 440. Vertical movement of the cam follower 262 rotates the miter gear assembly 444 back and forth causing the rod 440 to yaw around its longitudinal axis. The back and forth rotation of the rod 440 causes the head 18 mounted to a neck support 448 to rotate right and left.

Figure 32:
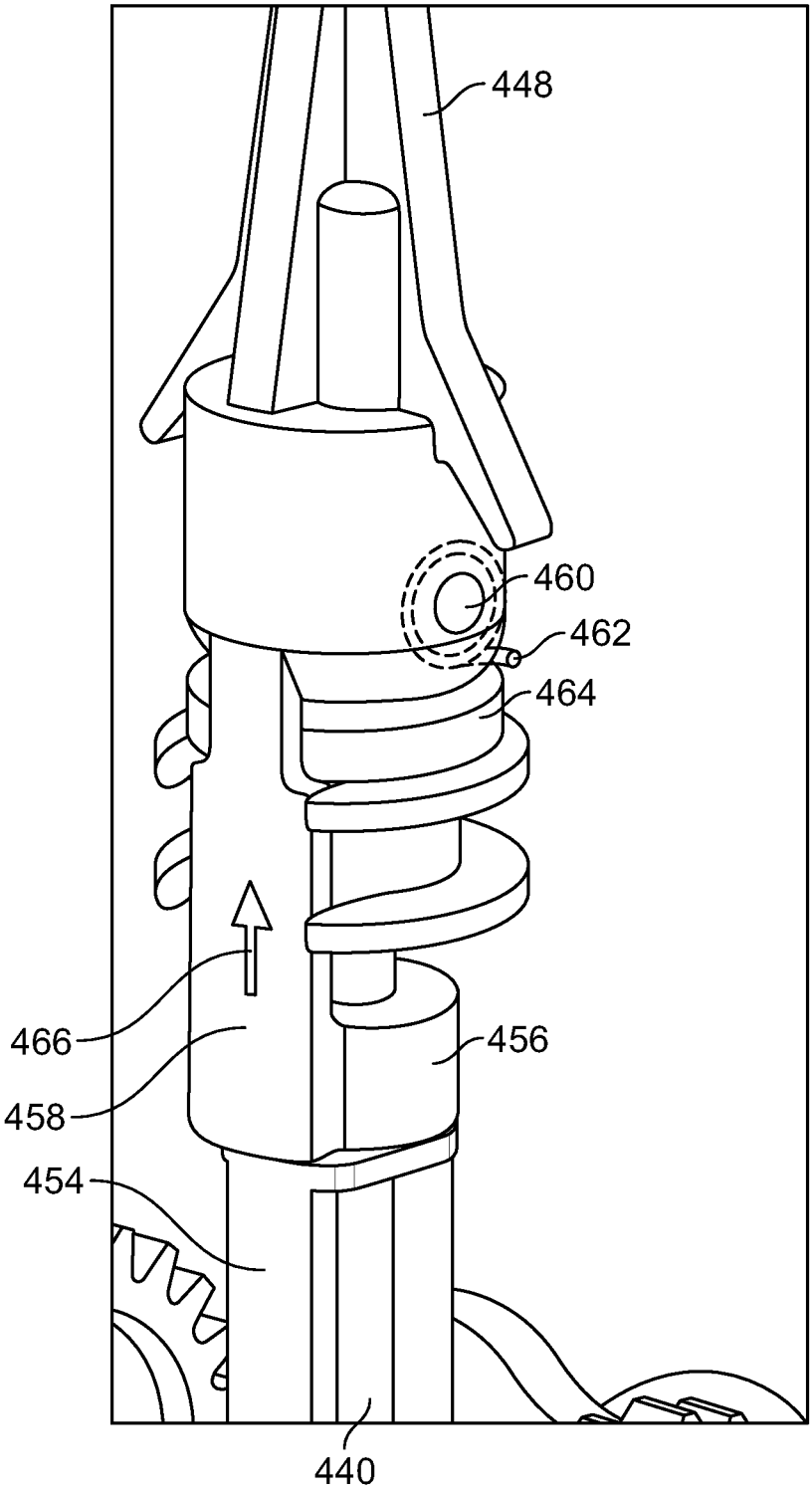
FIG. 32 is a further enlarged front isometric view of a pitch mechanism for the head.

A bracket 450, FIGS. 30 and 31, is coupled to the rod 440 above the spur gear 446, the bracket having a flat panel 452 and a long push rod 454. The flat panel 452 extends away from the rod 440, and the long push rod 454 extends upwards parallel to the rod 440. Mounted further up around the rod 440 are a base 456, FIGS. 30-32, and a short push rod 458 that engages the neck 448. The neck 448 is pivotally mounted around a horizontal pitch shaft 460, and a torsion spring 462 is mounted between the neck 448 and a bearing 464 mounted to the rod 440, such that an upward movement of the bracket 450 and the long push rod 454 causes an upward force on the base 456 which results in an upward movement of the short push rod 458, as indicated by an arrow 466, FIG. 32. The upward movement of the short push rod 458 causes the neck 448 to pivot upward around the shaft 460, and the torsion spring 462 returns the neck to its original position as shown in FIG. 32, once the short push rod 458 is lowered. The bearing 464 is constrained to rotate but prevented from vertical movement.

Mounted to another horizontal shaft 470, FIG. 31, just below the bracket 450, are fourth and fifth cams 472, 474. The fourth and fifth cams contact the flat panel 452 of the bracket 450 with their peripheries to cause vertical movement of the bracket 450. When the right and left cams 256, 258 are rotated, the fifth and sixth cam followers 268, 270 rotate gears 476, 478, and the gears 476, 478 rotate another set of gears 480, 482 mounted to the shaft 470 causing the cams 472, 474 to rotate and lift the bracket 450 and the long push rod 454. Lifting the long push rod 454 lifts the base 456, and the short push rod 458 tilts the neck 448 about the shaft 460. Tilting the neck 448 moves the head 18 forward. When the short push rod 458 returns downward, the torsion spring 462 returns the head to its original position, a generally horizontal position, such that the complete cycle generates something like a smooth head bob, and the gearing described above means that the head bob is linked to rotation of the arms.

In the alternative, the sizes and shapes of the elements, components and mechanisms of a toy robot may differ as a function of the design of the apparatus, whether it is a Belle doll, an action figure like HULK®, an animal, a vehicle or another structure. Sizes and shapes may also change to save weight, to ease production, to add robustness and/or to reduce costs.

In operation, rotation of the camshaft 252 causes all of the cam surfaces to move the multiple cam followers upward and downward, each in a preplanned sequence, resulting in the doll, when fully dressed, appearing to dance about a table top while moving its arms and head.

Figure 33:
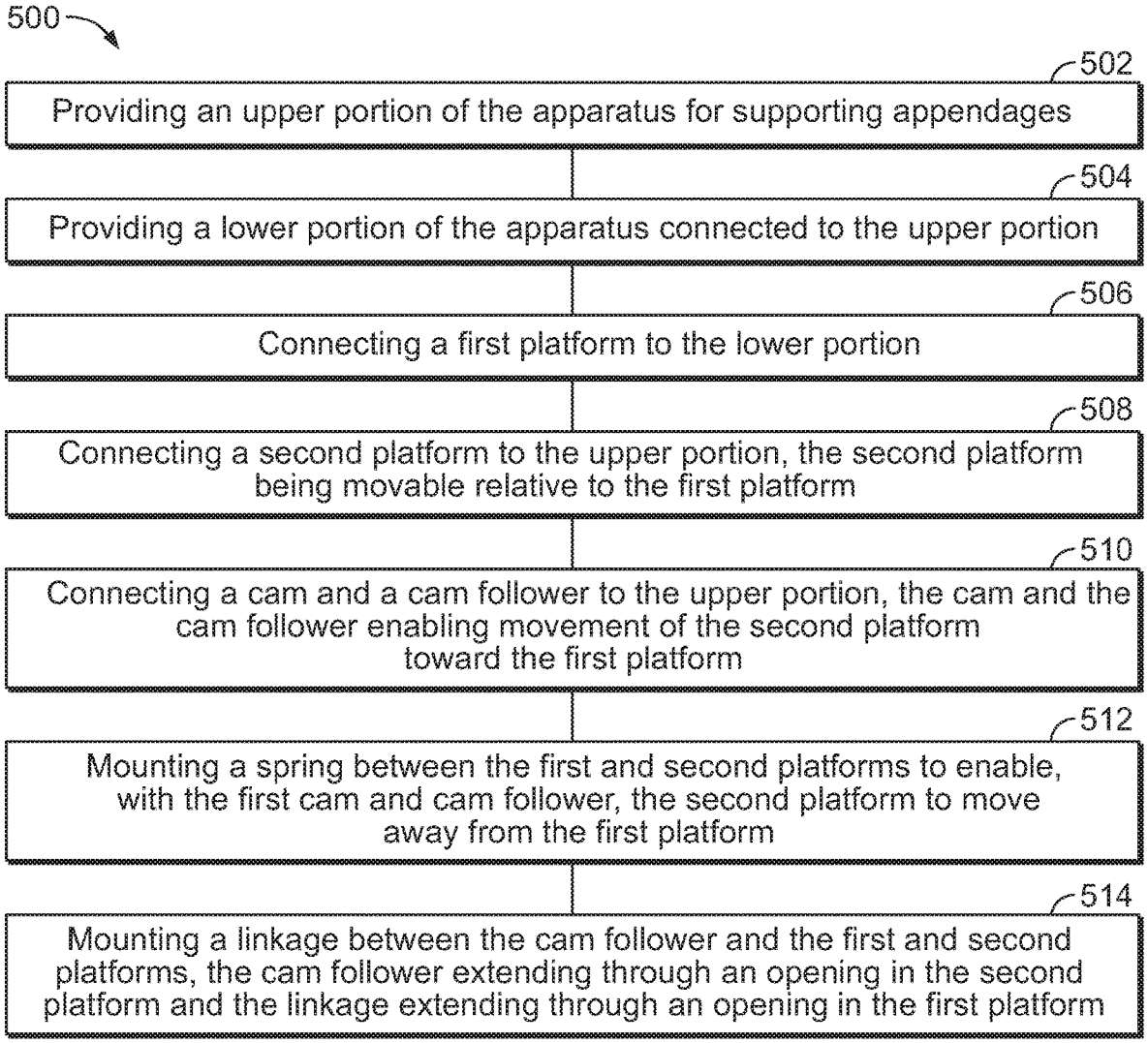
FIG. 33 is a flow diagram of a method for assembling a toy robot.

The present invention also includes a method 500, FIG. 33, for assembling a toy robot apparatus including the steps of providing an upper portion of the apparatus 502, providing a lower portion of the apparatus connected to the upper portion 504, connecting a first platform to the lower portion 506, connecting a second platform to the upper portion 508, the second platform being movable relative to the first platform, connecting a cam and a cam follower to the upper portion, the cam and cam follower enabling movement of the second platform toward the first platform 510, and mounting a spring between the first and second platforms to enable, with the cam and cam follower, the second platform to move away from the first platform 512. The method may also include mounting a linkage between the cam follower and the first and second platforms, the cam follower extending through an opening in the second platform and the linkage extending through an opening in the first platform 514.

It may now be appreciated that the toy doll robot and the alternative embodiments disclosed in detail above have great play value, are fun to use and easy to operate. The toy robot mechanisms are compact, relatively lightweight and robust, and yet have simple and reliable structures that may be produced at a reasonable cost.

From the foregoing, it can be seen that there has been provided features for an improved toy robot and alternatives and a disclosure of a method for assembling the toy robot. While particular embodiments of the present invention have been shown and described in detail, it will be obvious to those skilled in the art that changes and modifications may be made without departing from the invention in its broader aspects. Therefore, the aim is to cover all such changes and modifications as fall within the true spirit and scope of the invention. The matters set forth in the foregoing description and accompanying drawings are offered by way of illustrations only and not as limitations. The actual scope of the invention is to be defined by the subsequent claims when viewed in their proper perspective based on the prior art.

What is claimed is:

1. A toy robot apparatus comprising:

an upper portion having a movable head and two arms;

a movable lower portion for supporting the upper portion;

a microprocessor mounted in the apparatus for storing programs that enable the head, the arms and the lower portion to move;

a smart device having a graphical user interface handled remotely from the upper and lower portions by an operator, the smart device enabling the operator to program the microprocessor;

multiple cams and cam followers mounted in the upper portion for operating the head, the arms and the upper portion;

a first motor mounted in the lower portion for moving the apparatus along a surface;

a second motor mounted in the upper portion of the apparatus for receiving operating instructions from the microprocessor, for rotating the multiple cams and for moving the upper portion in a vertical direction without introducing tilt relative to the lower portion;

gears mounted in the apparatus for transmitting motion from the second motors; and a mechanism mounted in the apparatus for moving the upper portion relative to the lower portion, wherein the apparatus is enabled to perform dance routines by simultaneously moving along a surface, moving the head, moving the arms and having the upper portion move in a vertical direction, wherein:

the upper portion includes a tubular shape, the lower portion includes a tubular shape slightly larger than the upper portion;

the upper portion is enabled to slide into the lower portion to shorten the height of the apparatus, wherein the mechanism for moving the upper portion relative to the lower portion includes a first platform mounted to the lower portion and a second platform mounted to the upper portion, and only two pivotal links between the upper and lower platforms where the two pivotal links transmit motion between one of the cam followers and the second platform, one end of each of the first and the second pivotal links being pivotally mounted to the second platform, another end of the second link is pivotally mounted to the first link, the other end of the first link is slidably mounted to the first platform and the cam follower is slidably mounted to the second link; and a smart device having a first region with a first section illustrating input dance step icons and a second section illustrating input arm movement icons, and a second region with a sequence of icon receiving blocks for receiving icons dragged to the blocks by the operator, wherein the smart device displays a pattern of indicia in the second region setting forth a path to be followed by the toy robot.

2. A toy robot apparatus comprising:

an upper portion having a movable head and two arms;

a movable lower portion for supporting the upper portion;

a microprocessor mounted in the apparatus for storing programs that enable the head, the arms and the lower portion to move;

a smart device having a graphical user interface handled remotely from the upper and lower portions by an operator, the smart device enabling the operator to program the microprocessor;

multiple cams and cam followers mounted in the upper portion for operating the head, the arms and the upper portion;

a first motor mounted in the lower portion for moving the apparatus along a surface;

a second motor mounted in the upper portion of the apparatus for receiving operating instructions from the microprocessor, for rotating the multiple cams and for moving the upper portion in a vertical direction without introducing tilt relative to the lower portion;

gears mounted in the apparatus for transmitting motion from the second motors; and a mechanism mounted in the apparatus for moving the upper portion relative to the lower portion, wherein the apparatus is enabled to perform dance routines by simultaneously moving along a surface, moving the head, moving the arms and having the upper portion move in a vertical direction, wherein:

the upper portion includes a tubular shape, the lower portion includes a tubular shape slightly larger than the upper portion;

the upper portion is enabled to slide into the lower portion to shorten the height of the apparatus, wherein the mechanism for moving the upper portion relative to the lower portion includes a first platform mounted to the lower portion and a second platform mounted to the upper portion, and only two pivotal links between the upper and lower platforms where the two pivotal links transmit motion between one of the cam followers and the second platform, one end of each of the first and the second pivotal links being pivotally mounted to the second platform, another end of the second link is pivotally mounted to the first link, the other end of the first link is slidably mounted to the first platform and the cam follower is slidably mounted to the second link; and a smart device in the form of a smart tablet having a first region with a first section illustrating input dance step icons and a second section illustrating input arm movement icons, and a second region with a series of numbered dots for receiving the icons in the second region of the tablet chosen by the operator, wherein said tablet displays a pattern of indicia in the second region setting forth a path to be followed by the toy robot.

3. A toy robot apparatus comprising:

a movable upper portion having movable appendages;

a movable lower portion for supporting the upper portion;

a microprocessor mounted in the apparatus for storing programs that enable the appendages to move;

a smart device having a graphical user interface handled remotely from the upper and lower portions by an operator, the smart device enabling the operator to program the microprocessor;

a first mechanism and a first motor located in the lower portion, the first motor for operating the first mechanism to cause the lower portion to move along a surface;

a second mechanism and a second motor located in the upper portion, the second motor for operating the second mechanism for causing the appendages to move in a repeatable manner wherein the second mechanism includes a plurality of cams, each cam connected to one of a plurality of cam followers for moving the appendages; and a third mechanism located in the apparatus and operated by the second motor through the second mechanism with the second motor causing the third mechanism to move the upper portion solely in a vertical direction relative to the lower portion to perform dance routines by simultaneously operating the first motor and the second motor and moving the lower portion on a surface, wherein all of the cam followers except one extend upward in the upper portion and one of the cam followers extends downward into the third mechanism for moving the upper portion vertically relative to the lower portion, the third mechanism includes a first platform mounted to the lower portion and a second platform mounted to the upper portion; and a linkage for transferring motion of the downward extending cam follower, wherein the linkage includes first and second links, one end of each of the first and the second links being pivotally mounted to the second platform, the other end of the second link being pivotally mounted to the first link, the other end of the first link being slidably mounted to the first platform and the downward extending cam follower being slidably mounted to the second link between the ends of the second link.

4. The toy robot apparatus as claimed in claim 3, wherein:

the smart device having a first region with a first section illustrating input dance step icons and a second section illustrating input arm movement icons, and a second region with a sequence of icon receiving blocks for receiving icons dragged to the blocks by the operator; and the smart device displays a pattern of indicia in the second region setting forth a path to be followed by the toy robot.

5. The toy robot as claimed in claim 3, wherein:

the smart device in the form of a smart tablet having a first region with a first section illustrating input dance step icons and a second section illustrating input arm movement icons, and a second region with a series of numbered dots for receiving the icons in the second region of the tablet chosen by the operator; and said tablet displays a pattern of indicia in the second region setting forth a path to be followed by the toy robot.

* * * * *